US012760948B2

(12) United States Patent
Mohammad et al.

(10) Patent No.: US 12,760,948 B2
(45) Date of Patent: Oct. 13, 2026

(54) ARRANGEMENT FOR REFRIGERANT LEAK MANAGEMENT

(71) Applicant: Tyco Fire & Security GmbH, Neuhausen am Rheinfall (CH)

(72) Inventors: Mujibul Rehaman Mohammad, Kakinada (IN); Anthony J. Reardon, Moore, OK (US); Praveen Gotakhindi, Pune (IN); Karan Garg, Pune (IN); Curtis Wayne Caskey, Dallastown, PA (US); Karla Daniela Alvarez Cavazos, York, PA (US); Hari Venkatesh Balasubramanian, Pune (IN); Gurpreet Singh, Alwar (IN)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/784,720

(22) Filed: Jul. 25, 2024

(65) Prior Publication Data

US 2025/0035355 A1 Jan. 30, 2025

Related U.S. Application Data

(60) Provisional application No. 63/528,855, filed on Jul. 25, 2023.

(51) Int. Cl.

| | |
|---|---|
| ***G08B 21/00*** | (2006.01) |
| ***F25B 41/40*** | (2021.01) |
| ***F25B 49/00*** | (2006.01) |

(52) U.S. Cl.

CPC ..... *F25B 49/005* (2013.01); *F25B 41/40* (2021.01); *F25B 2500/222* (2013.01)

(58) Field of Classification Search

CPC .. F25B 49/005; F25B 41/40; F25B 2500/222; F25B 13/00; F24F 2110/65; F24F 11/36

USPC ..... 340/605

See application file for complete search history.

(56) References Cited

U.S. PATENT DOCUMENTS

| | | | | |
|---|---|---|---|---|
| 11,125,457 | B1 * | 9/2021 | Alfano | F24F 11/36 |
| 12,253,273 | B1 * | 3/2025 | Dudek | G08B 21/18 |
| 2019/0170383 | A1 * | 6/2019 | Weinert | F25B 49/025 |
| 2019/0170600 | A1 * | 6/2019 | Tice | G01M 3/2815 |
| 2021/0148620 | A1 * | 5/2021 | Yamada | F25B 13/00 |
| 2021/0302056 | A1 * | 9/2021 | Eskew | F24F 1/0063 |
| 2021/0381708 | A1 * | 12/2021 | Butler | F25B 41/24 |
| 2022/0034535 | A1 * | 2/2022 | Kobayashi | F24F 3/06 |
| 2023/0235907 | A1 * | 7/2023 | DeWald | F24F 11/36 |
| 2023/0296301 | A1 * | 9/2023 | Taras | F24F 11/36 62/129 |

* cited by examiner

*Primary Examiner* — Tai T Nguyen
(74) *Attorney, Agent, or Firm* — Fletcher Yoder, P.C.

(57) ABSTRACT

A rooftop unit (RTU) includes a refrigerant leak detection assembly. The refrigerant leak detection assembly includes one or more refrigerant leak detectors (e.g., sensors). For example, a first refrigerant leak detector may be positioned in the RTU adjacent to a brazed joint between first and second portions of a fluid conduit, a second refrigerant leak detector may be positioned in a control box of the RTU, and/or a third refrigerant leak detector may be positioned on a blower of the RTU or in an air flow chamber fluidly coupled with a return air inlet of the RTU. Other locations of the refrigerant leak detector(s) are also possible.

13 Claims, 27 Drawing Sheets

ARRANGEMENT FOR REFRIGERANT LEAK MANAGEMENT

CROSS-REFERENCE TO RELATED APPLICATIONS

This application claims priority to and the benefit of U.S. Provisional Patent Application Ser. No. 63/528,855, entitled "AN ARRANGEMENT FOR REFRIGERANT LEAK MANAGEMENT," filed Jul. 25, 2023, which is incorporated herein by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates generally to refrigerant leak detection assemblies in a heating, ventilating, and/or air conditioning (HVAC) system, such as a rooftop unit (RTU).

An HVAC system provides proper ventilation and maintains air quality in a confined space, such as a commercial or a household building. The HVAC system circulates a refrigerant through a closed circuit (e.g., refrigerant loop or circuit, vapor compression loop or circuit) including a compressor, a condenser, an expansion device, and an evaporator. Refrigerant in the evaporator is utilized to cool an air flow via thermal exchange to condition the confined space. However, traditional refrigerants possess certain drawbacks. Although such traditional refrigerants are effective coolants, for example, they may have high global warming potential (GWP). High GWP refrigerants have been replaced in certain traditional configurations with more environmentally friendly refrigerants, such as A2L refrigerants. Although A2L refrigerants have relatively low GWP, they may be flammable. Accordingly, it is now recognized that improved HVAC systems and methods mitigating technical problems associated with A2L refrigerants are desired.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a rooftop unit (RTU) includes a fluid conduit configured to convey a refrigerant. The fluid conduit includes a first portion, a second portion, and a brazed joint coupling the first portion and the second portion. The RTU also includes refrigerant leak detectors, including at least one refrigerant leak detector positioned adjacent to the brazed joint. Other refrigerant leak detectors of the RTU may be positioned elsewhere.

In another embodiment, a rooftop unit (RTU) includes a chamber, an additional chamber, and at least one panel positioned between the chamber and the additional chamber. The at least one panel includes an opening establishing a fluid coupling between the chamber and the additional chamber. The RTU also includes refrigerant leak detectors, including at least one refrigerant leak detector positioned in the additional chamber and configured to detect a migration of leaked refrigerant from the chamber, through the opening, and into the additional chamber. Other refrigerant leak detectors of the RTU may be positioned elsewhere.

In still another embodiment, a rooftop unit (RTU) includes a chamber, a blower positioned in the chamber and configured to generate an air flow, and an additional chamber upstream of the chamber relative to the air flow (e.g., where the additional chamber is fluidly coupled with a return air inlet of the RTU), and a filter assembly separating the chamber and the additional chamber. The RTU also includes refrigerant leak detectors, including at least one refrigerant leak detector positioned in the chamber or the additional chamber. Other refrigerant leak detectors of the RTU may be positioned elsewhere.

BRIEF DESCRIPTION OF THE DRAWINGS

Various aspects of this disclosure may be better understood upon reading the following detailed description and upon reference to the drawings in which.

Figure 5:
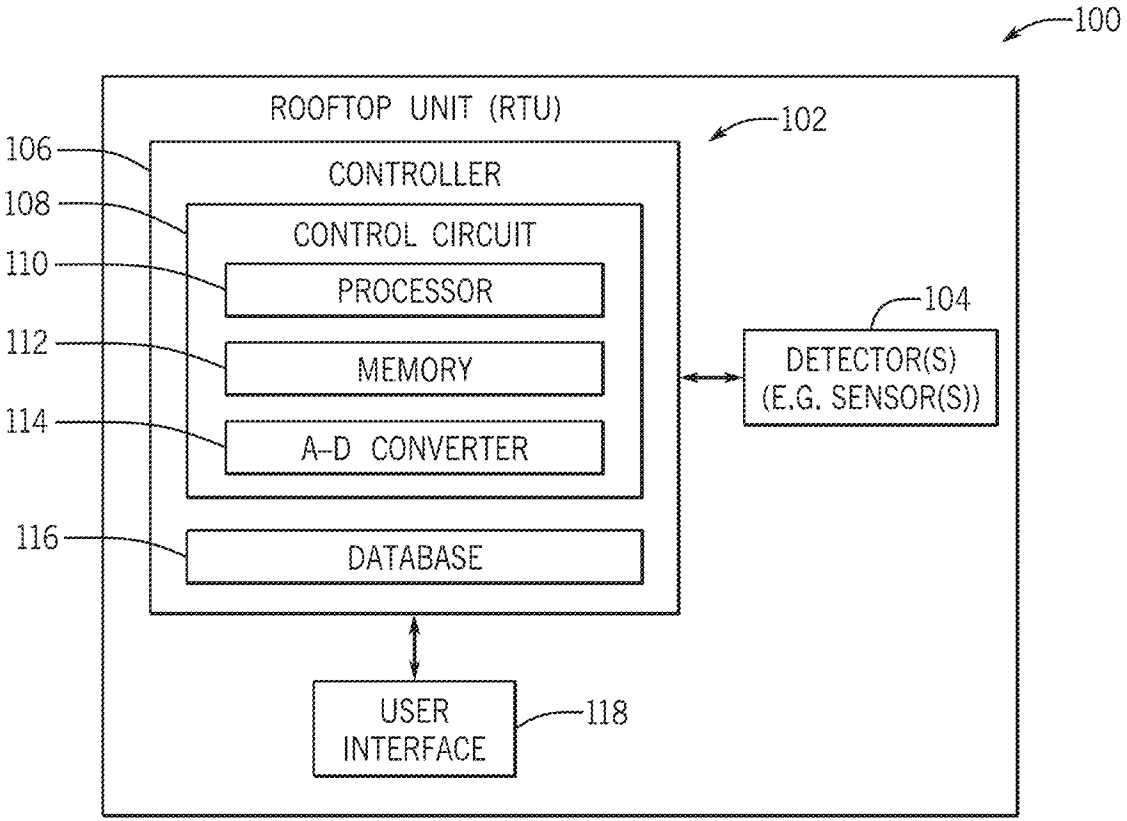
FIG. 5 is a block diagram of an embodiment of a rooftop unit (RTU) having a refrigerant leak detection assembly, in accordance with an aspect of the present disclosure.
Figure 6:
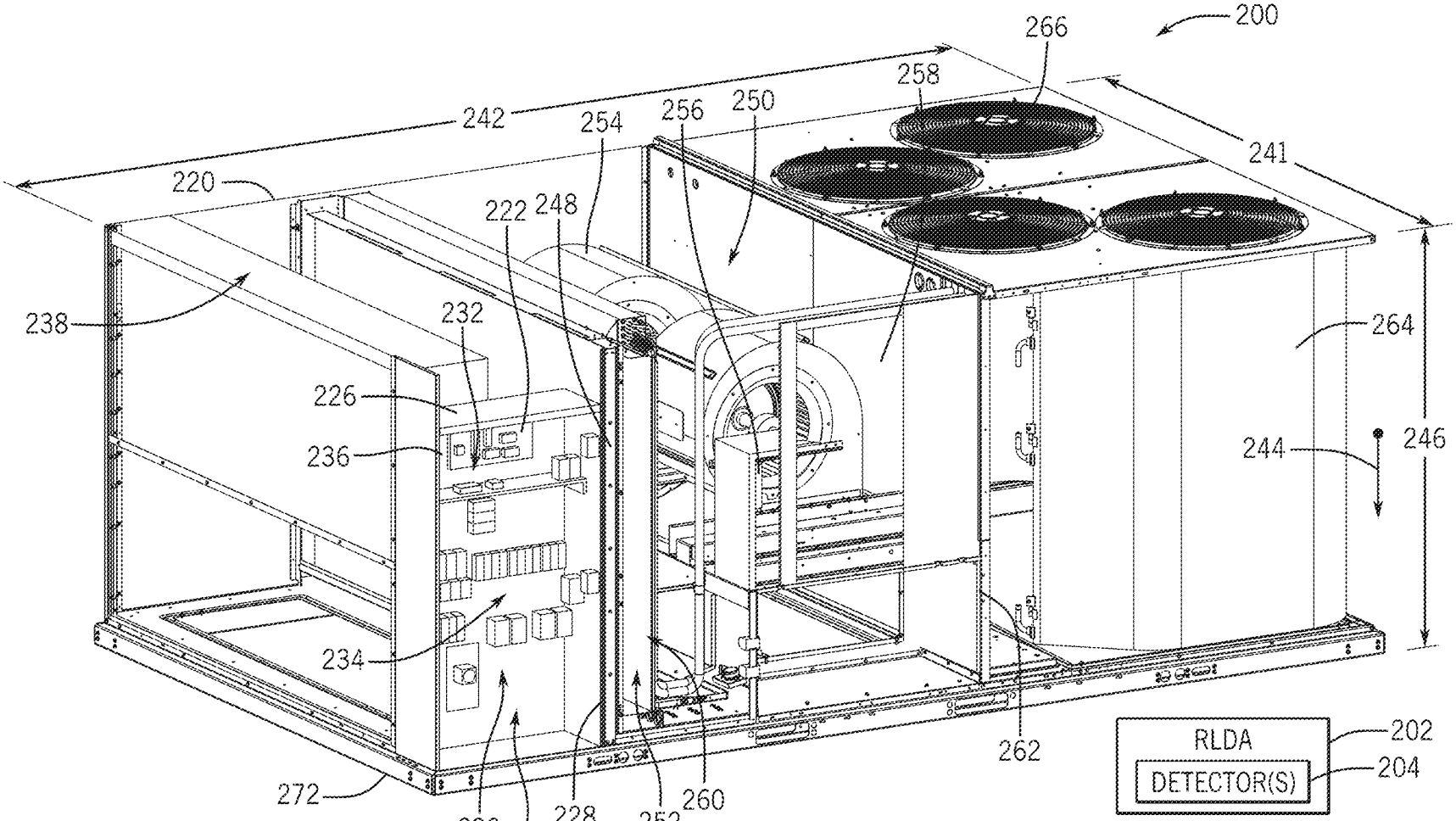
FIG. 6 is an isometric view of an embodiment of the RTU of FIG. 5, including the refrigerant leak detection assembly, in accordance with an aspect of the present disclosure.
Figure 10:
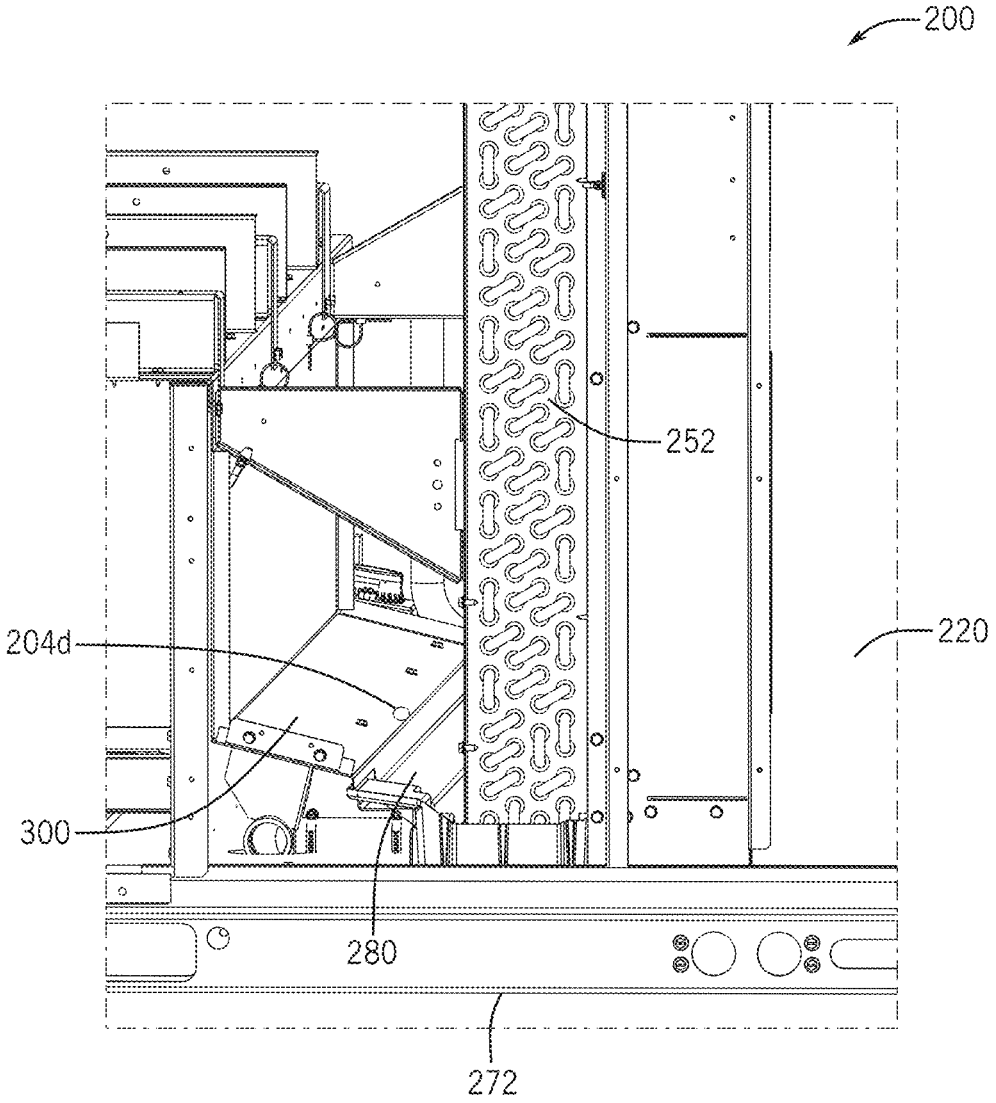
FIG. 10 is an isometric view of a portion of the RTU of FIG. 6, including a fourth refrigerant leak detector (e.g., used in addition to or in lieu of one or more other refrigerant leak detector[s] in FIGS. 8 and 9) of the refrigerant leak detection assembly, in accordance with an aspect of the present disclosure.
Figure 11:
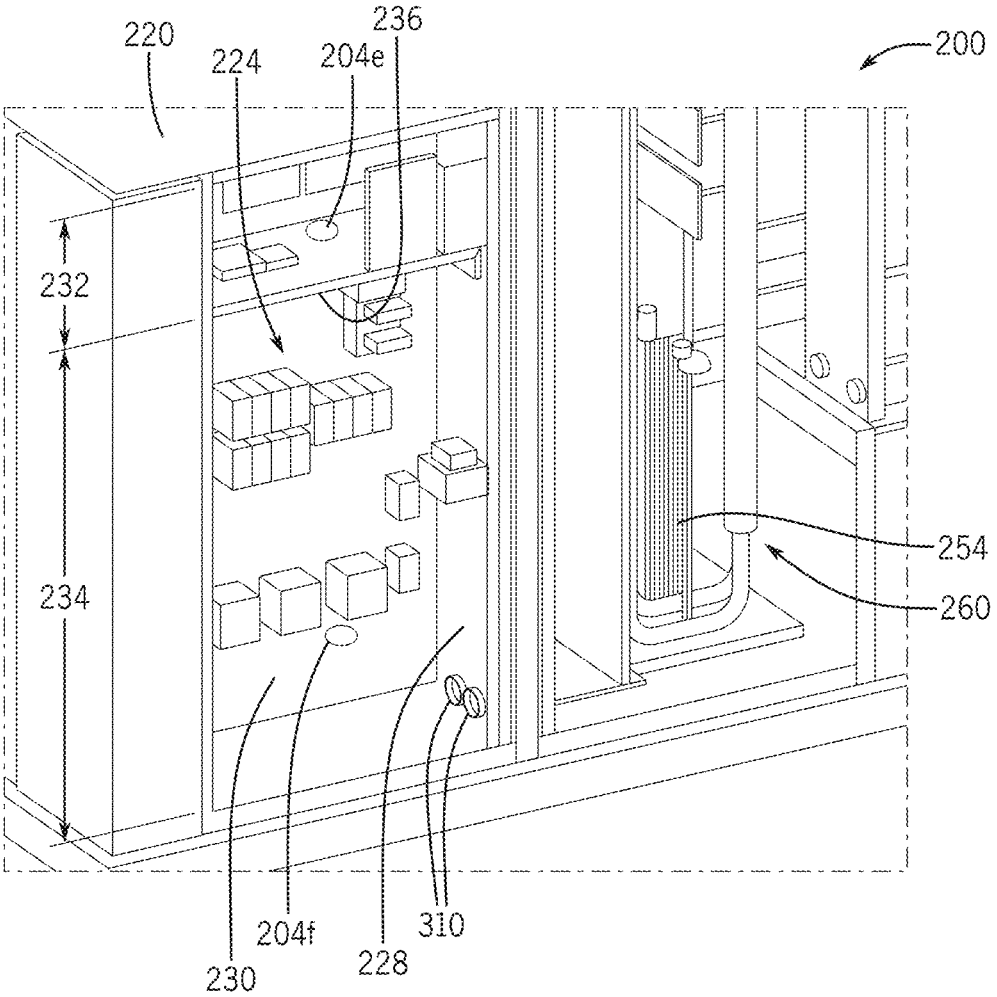
FIG. 11 is an isometric view of a portion of the RTU of FIG. 6, including a fifth refrigerant leak detector and a sixth refrigerant leak detector (e.g., used in addition to or in lieu of one or more other refrigerant leak detector[s] in FIGS.
Figure 12:
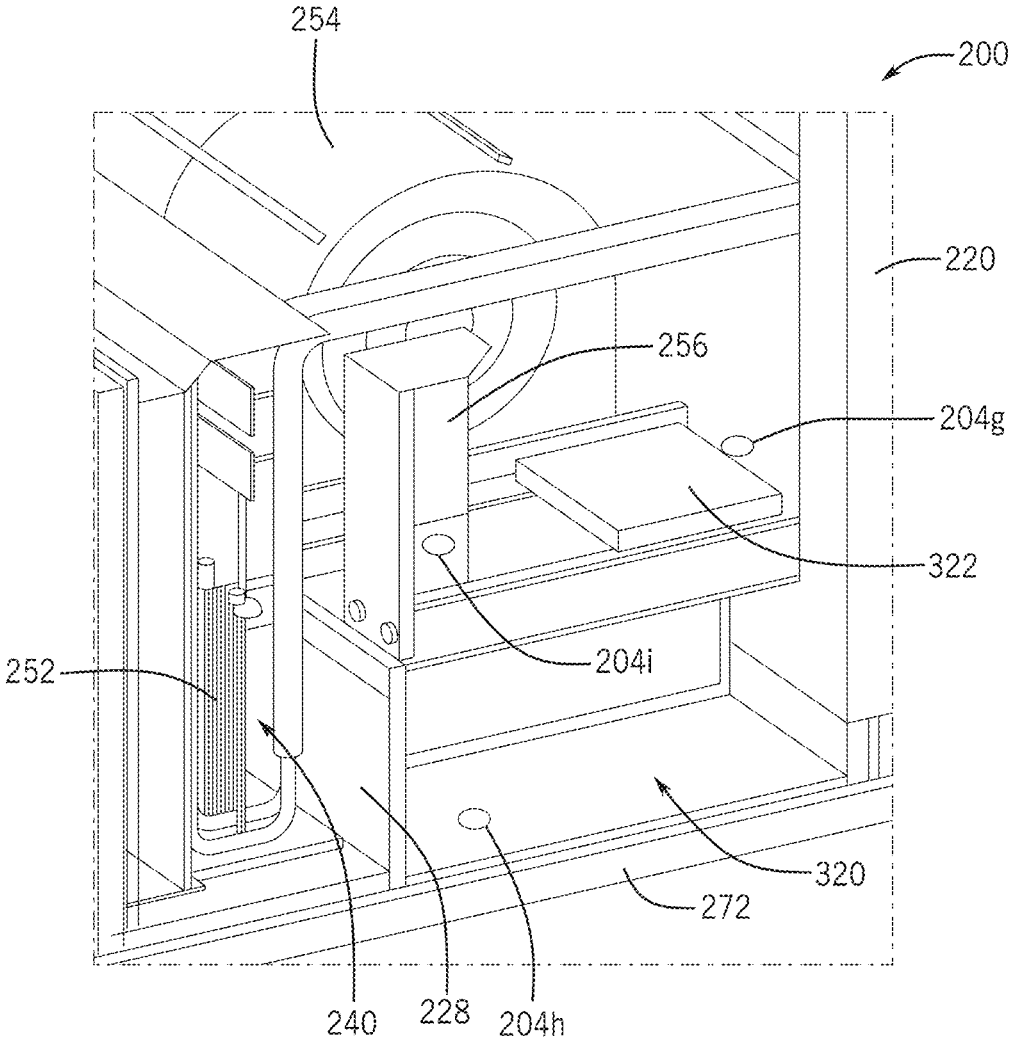
Figure 13:
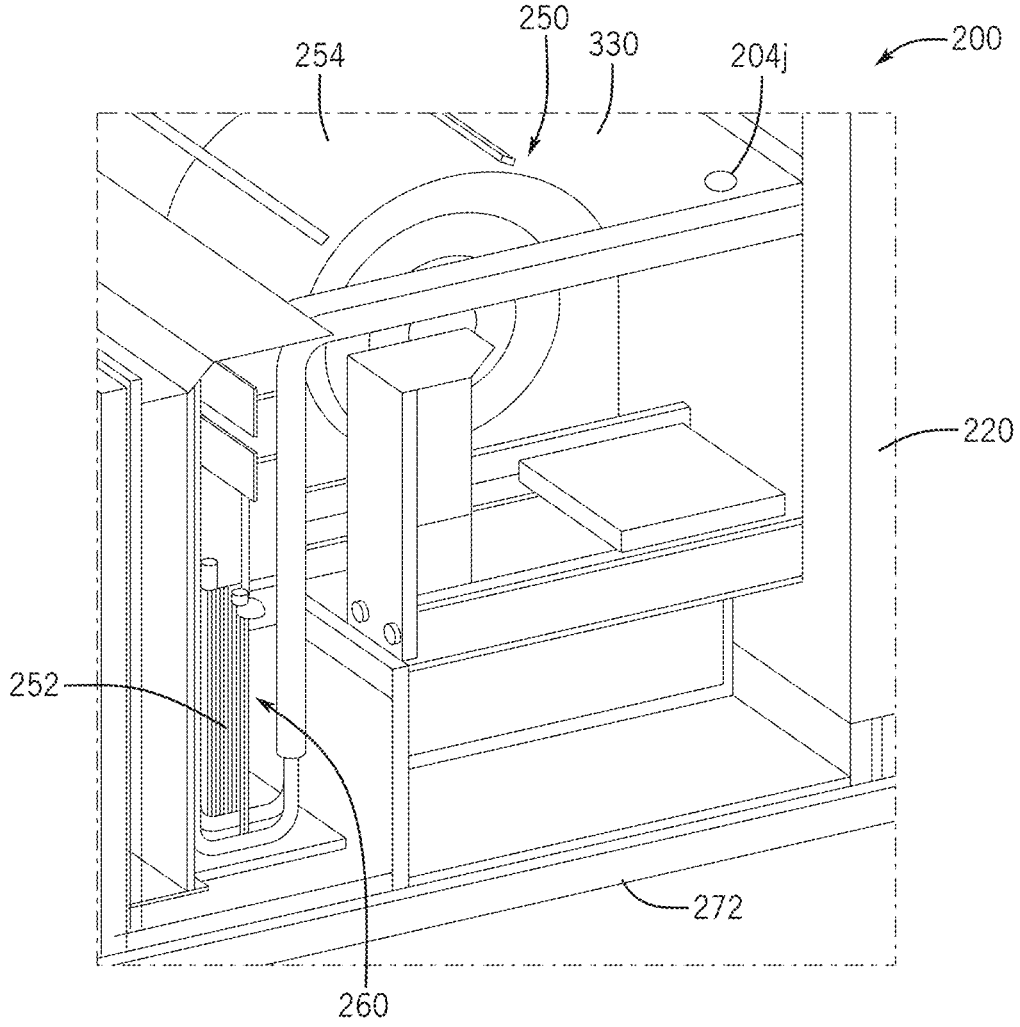
Figure 14:
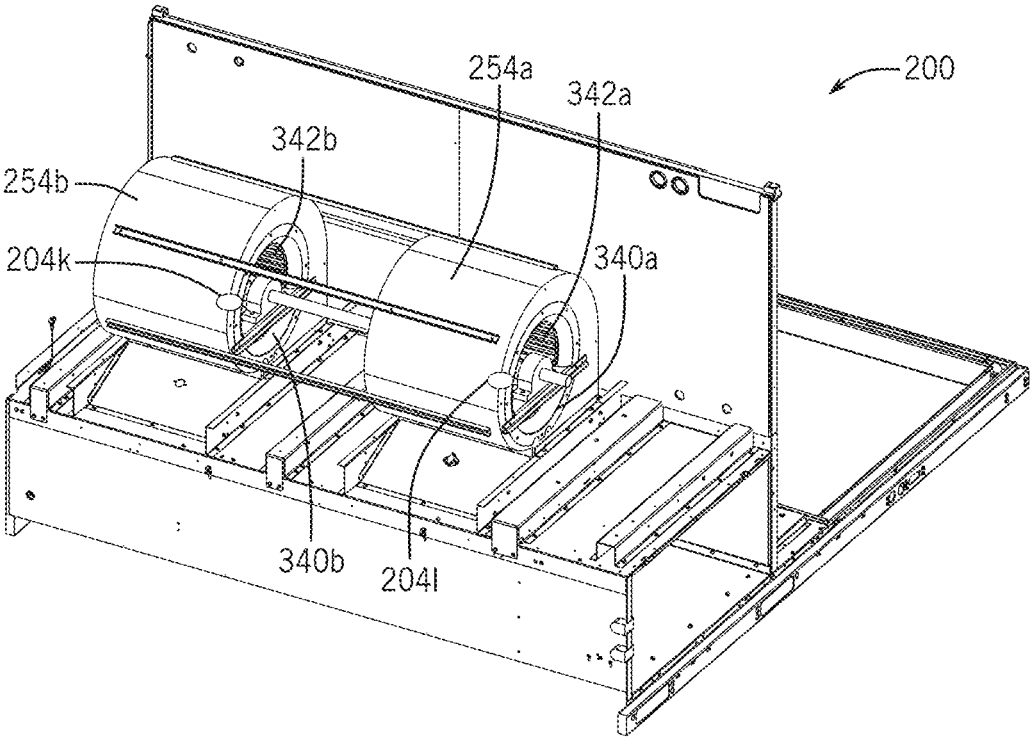
Figure 15:
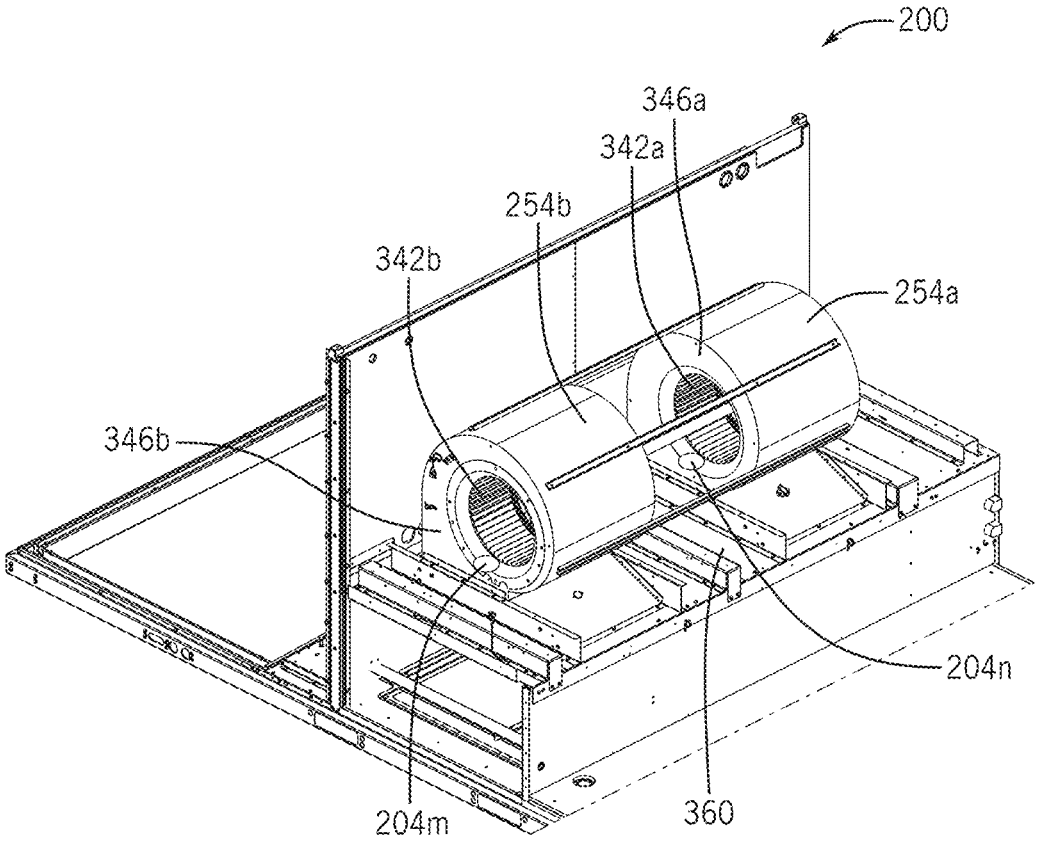
Figure 16:
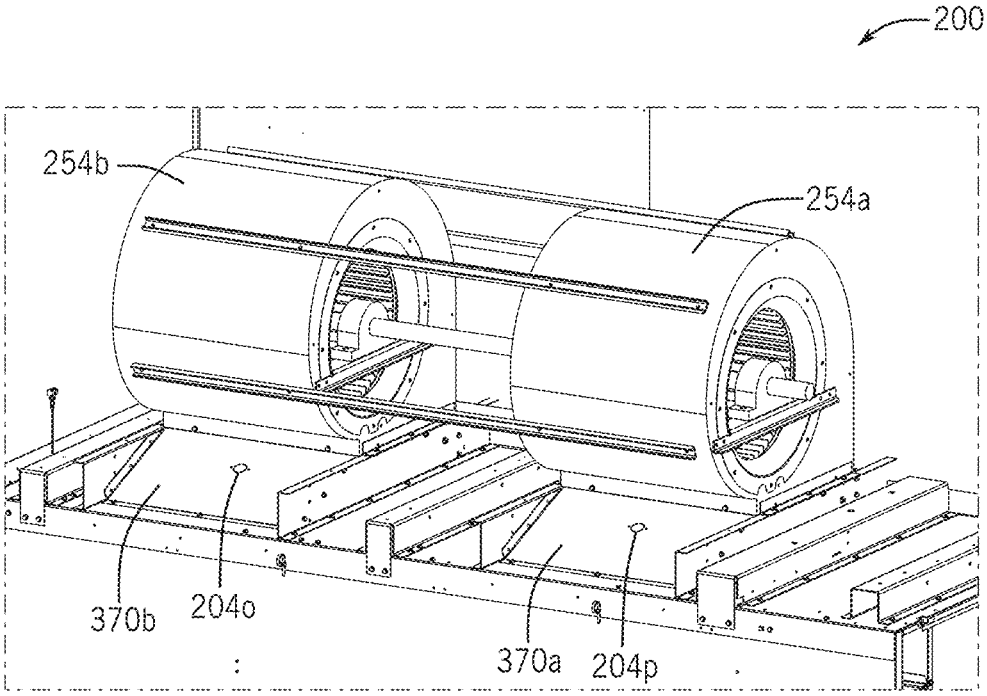
Figure 17:
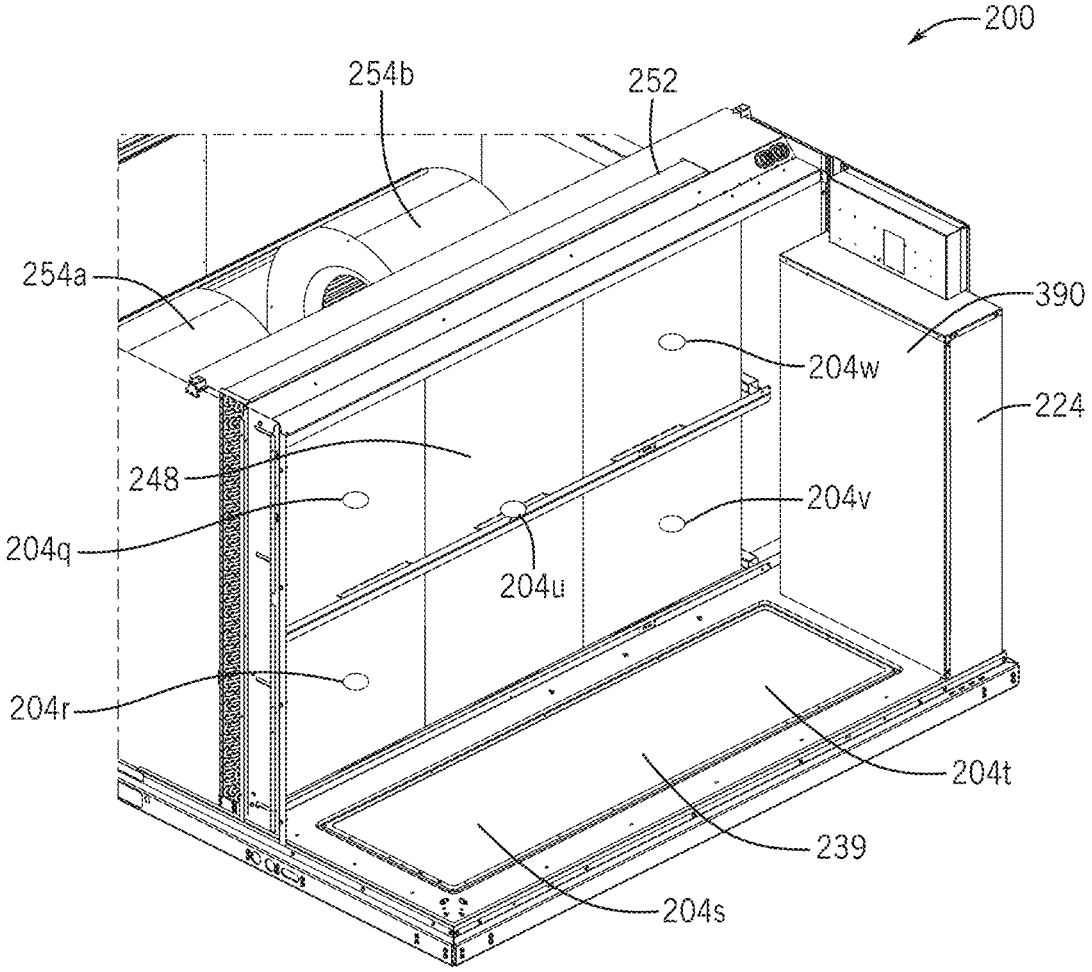
Figure 18:
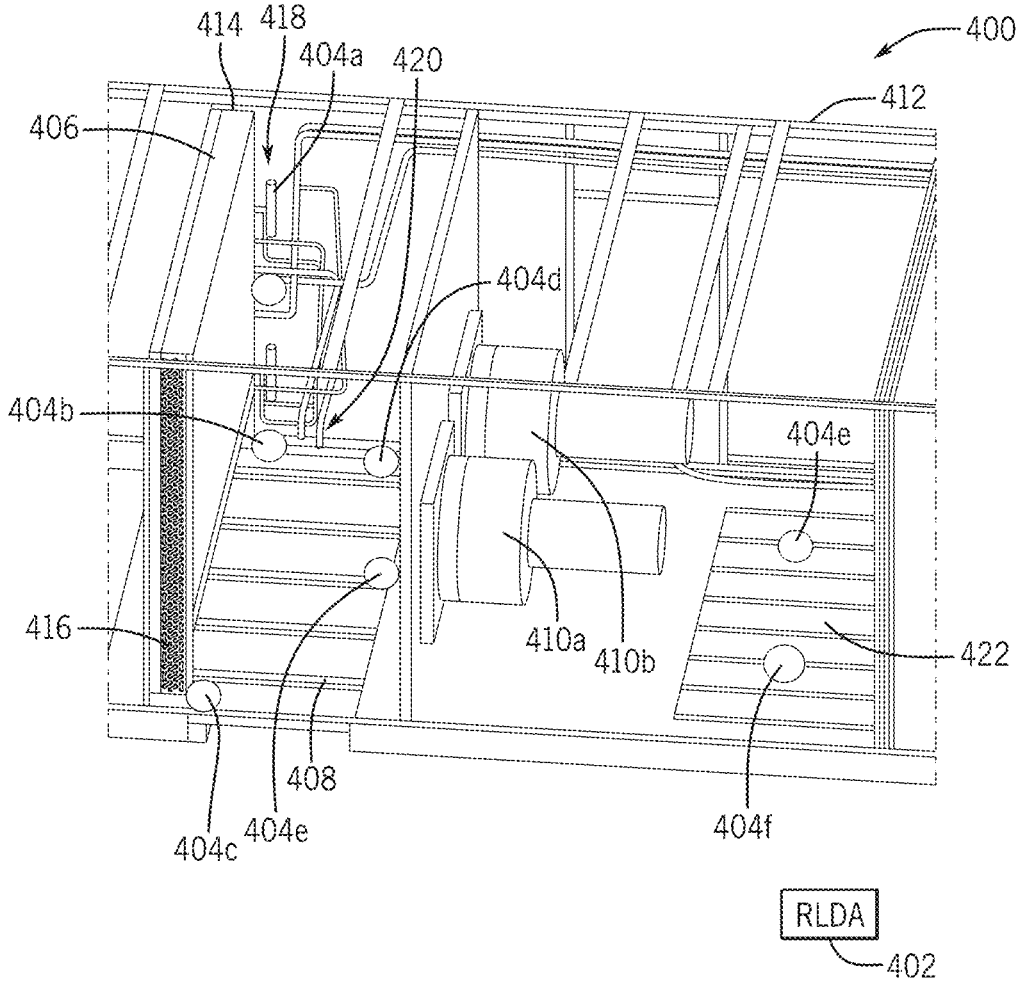
Figure 19:
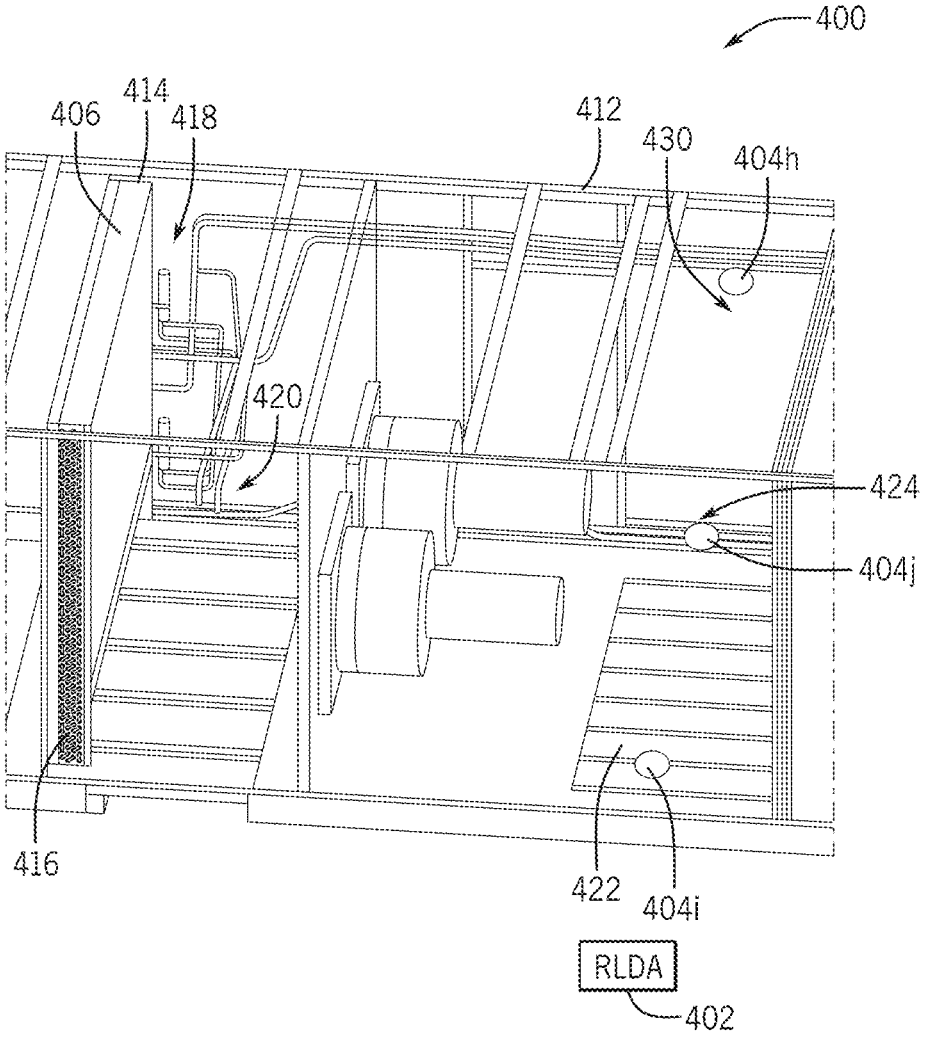
Figure 20:
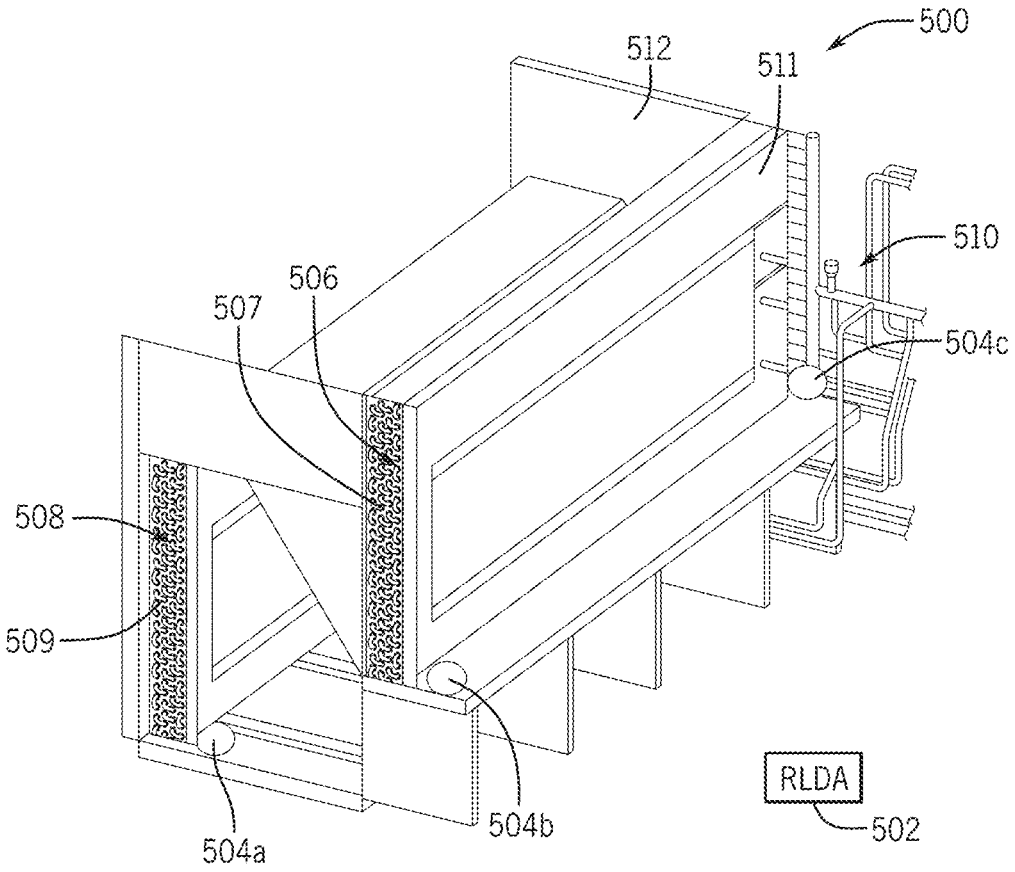
Figure 21:
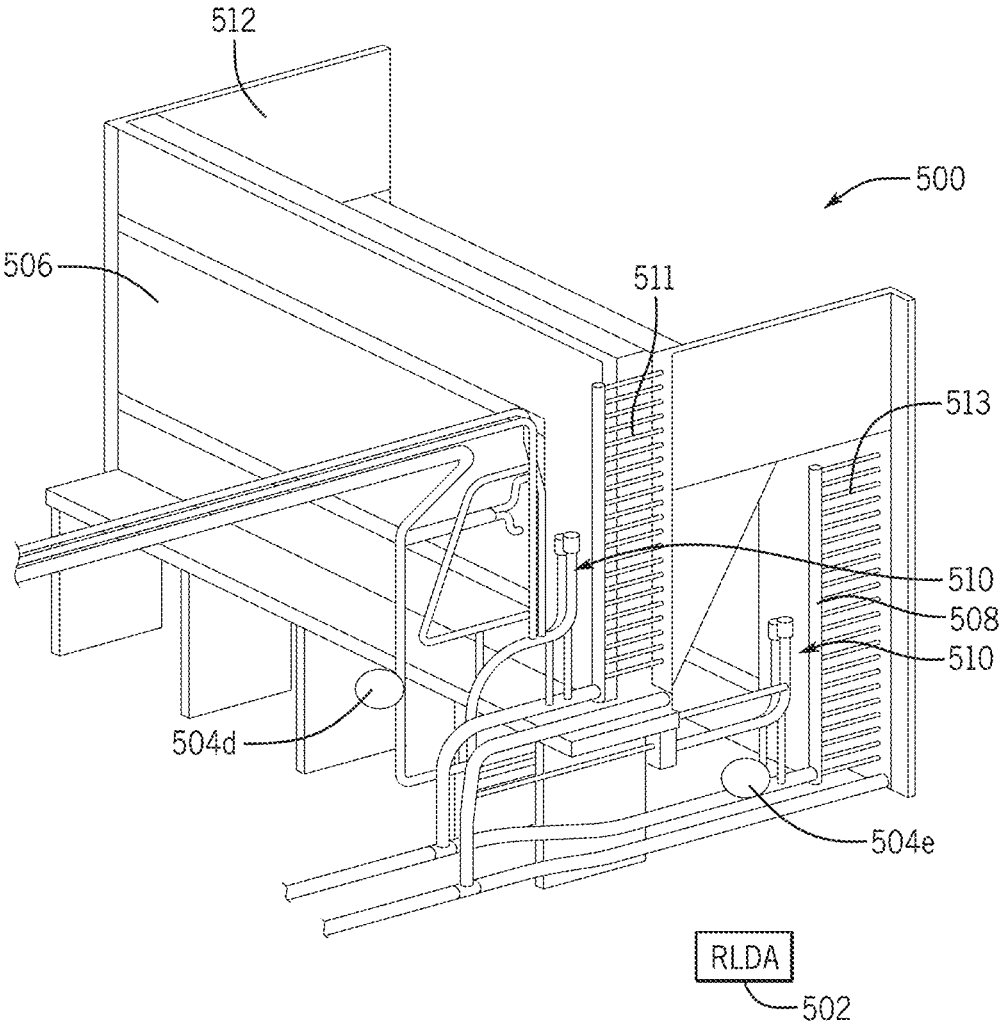
Figure 22:
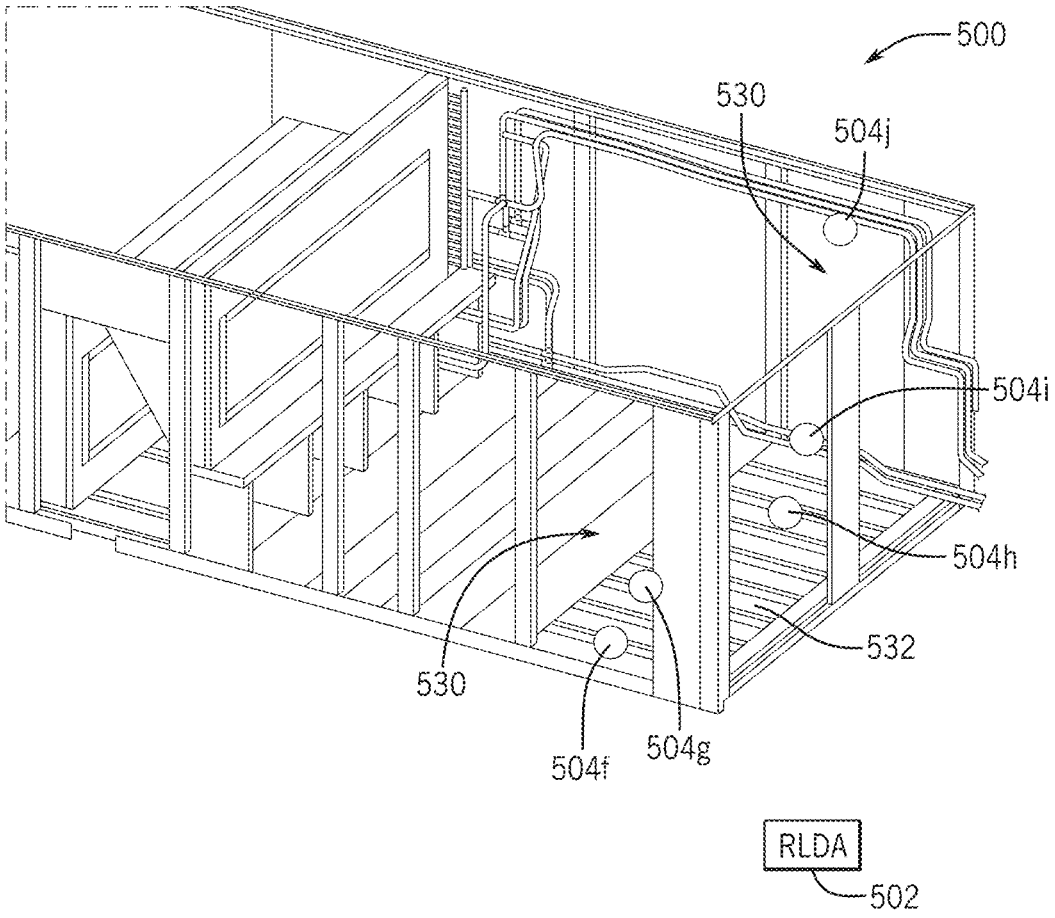
Figure 23:
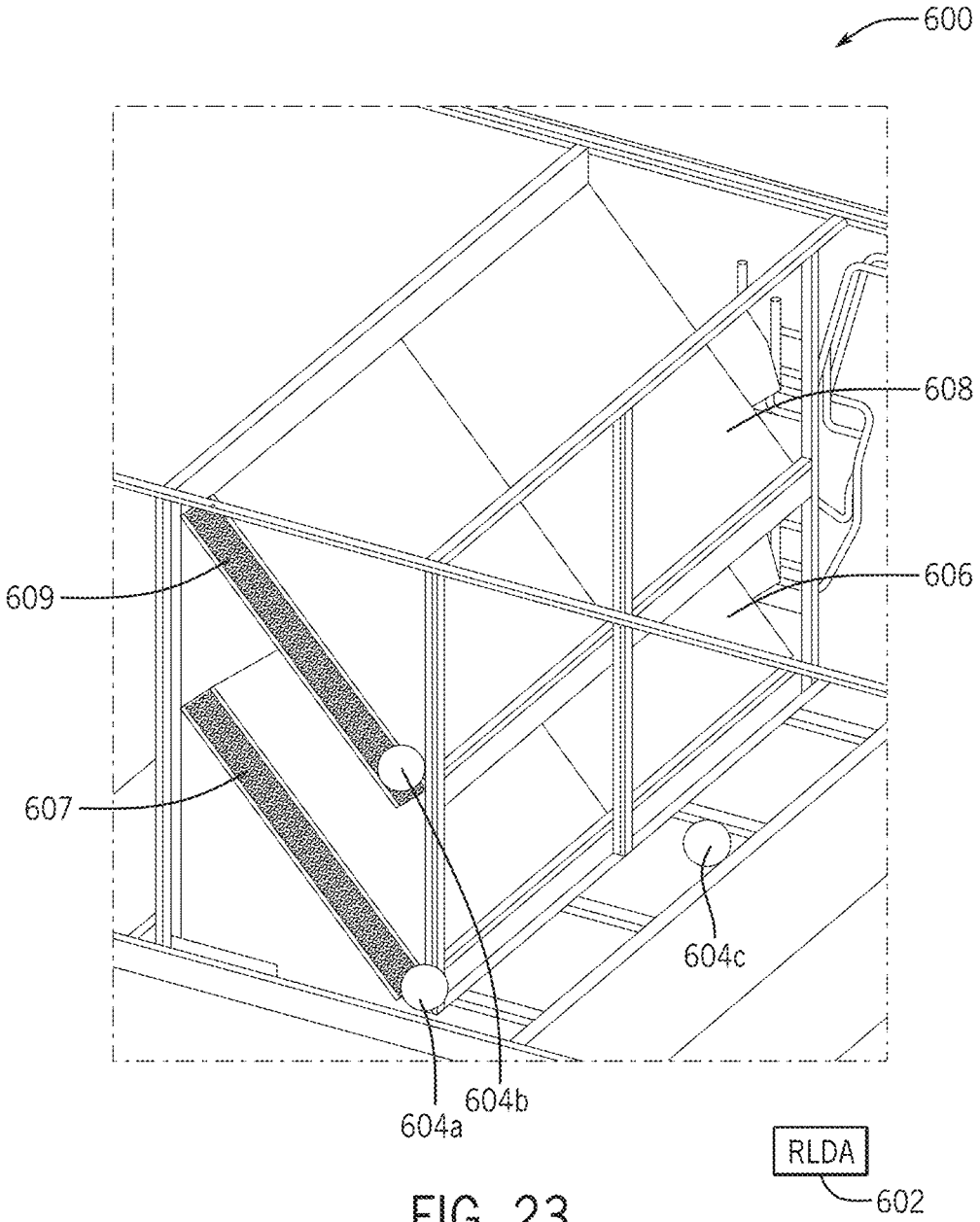
Figure 24:
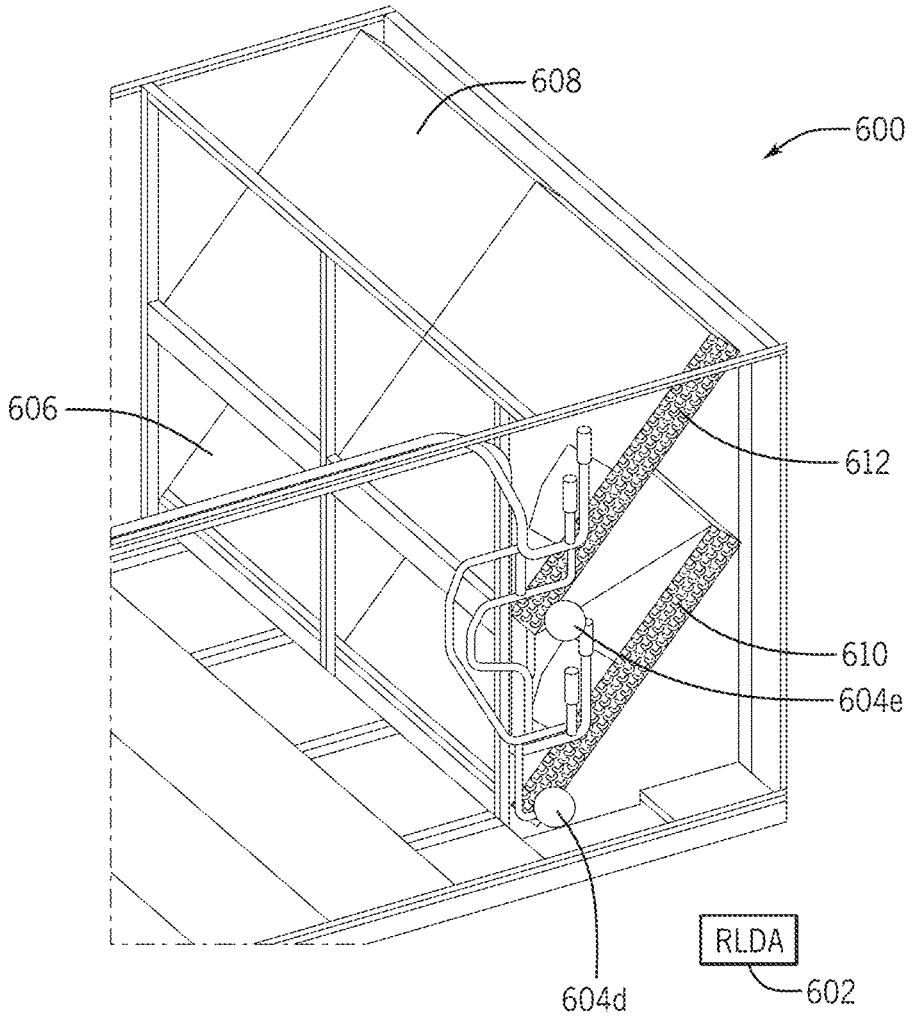
Figure 25:
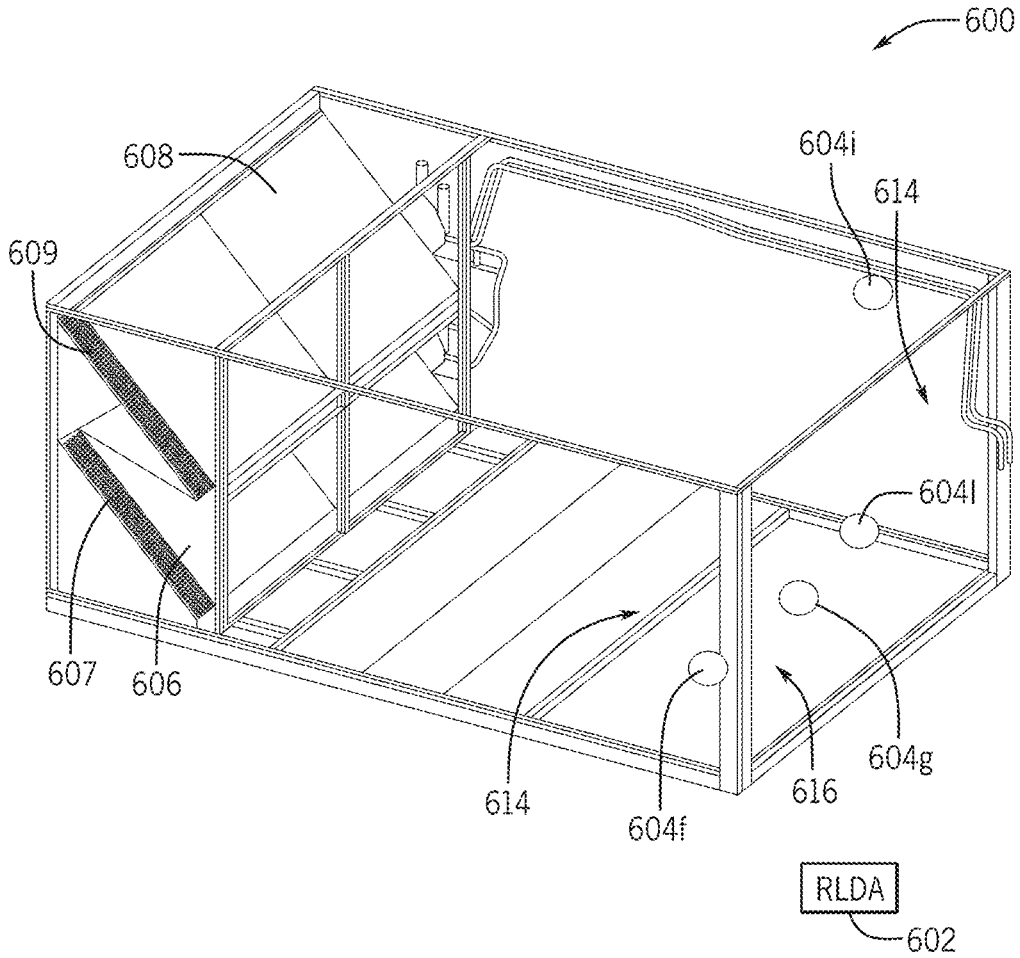
Figure 26:
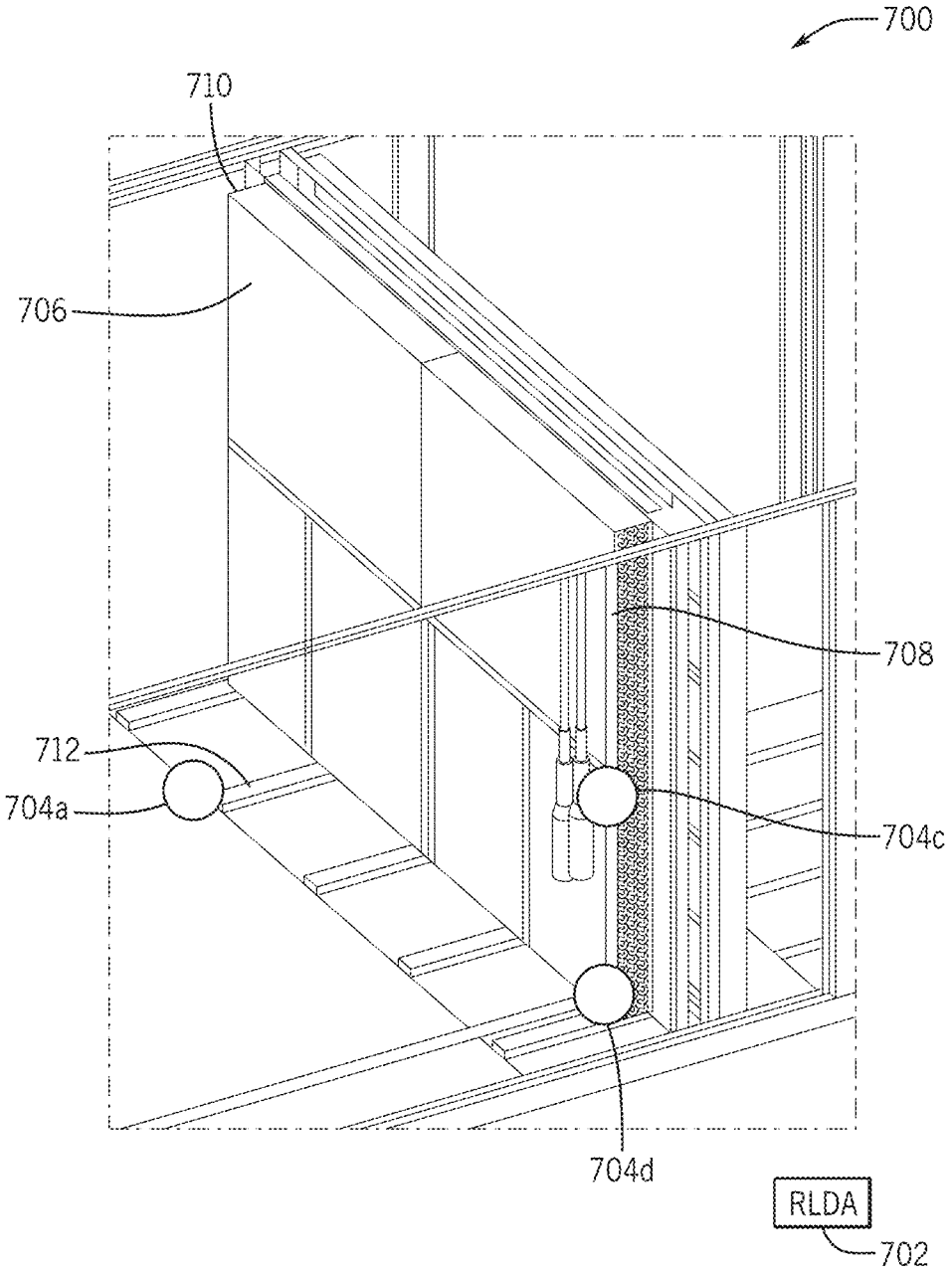
Figure 27:
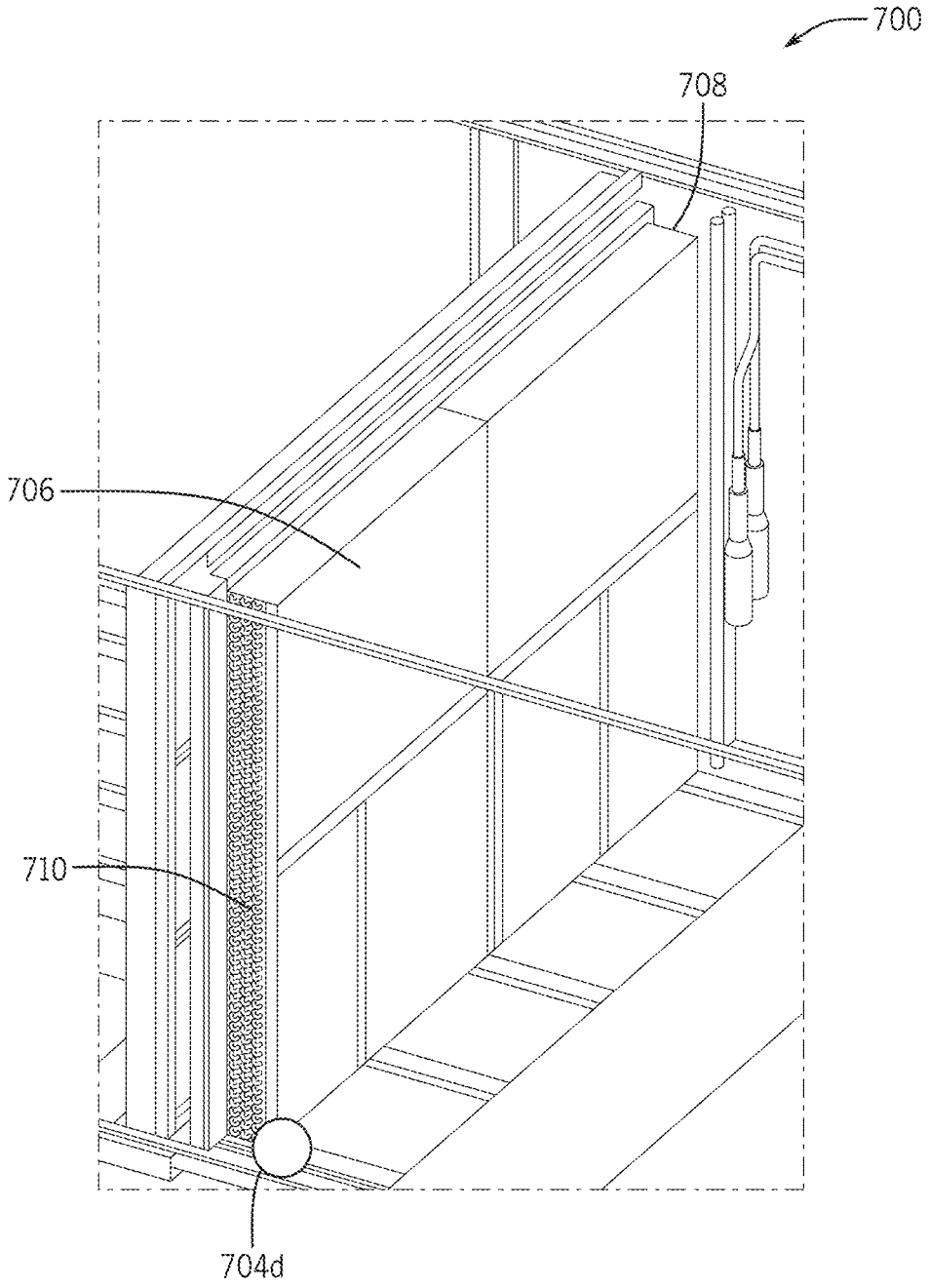

8-10) of the refrigerant leak detection assembly, in accordance with an aspect of the present disclosure;

FIG. 12 is an isometric view of a portion of the RTU of FIG. 6, including a seventh refrigerant leak detector, an eighth refrigerant leak detector, and ninth refrigerant leak detector (e.g., used in addition to or in lieu of one or more other refrigerant leak detector[s] in FIGS. 8-11) of the refrigerant leak detection assembly, in accordance with an aspect of the present disclosure;

FIG. 13 is an isometric view of a portion of the RTU of FIG. 6, including a tenth refrigerant leak detector (e.g., used in addition to or in lieu of one or more other refrigerant leak detector[s] in FIGS. 8-12) of the refrigerant leak detection assembly, in accordance with an aspect of the present disclosure;

FIG. 14 is an isometric view of a portion of the RTU of FIG. 6, including an eleventh refrigerant leak detector and a twelfth refrigerant leak detector (e.g., used in addition to or in lieu of one or more other refrigerant leak detector[s] in FIGS. 8-13) of the refrigerant leak detection assembly, in accordance with an aspect of the present disclosure;

FIG. 15 is an isometric view of a portion of the RTU of FIG. 6, including a thirteenth refrigerant leak detector and a fourteenth refrigerant leak detector (e.g., used in addition to or in lieu of one or more other refrigerant leak detector[s] in FIGS. 8-14) of the refrigerant leak detection assembly, in accordance with an aspect of the present disclosure;

FIG. 16 is an isometric view of a portion of the RTU of FIG. 6, including a fifteenth refrigerant leak detector and a sixteenth refrigerant leak detector (e.g., used in addition to or in lieu of one or more other refrigerant leak detector[s] in FIGS. 8-15) of the refrigerant leak detection assembly, in accordance with an aspect of the present disclosure;

FIG. 17 is an isometric view of a portion of the RTU of FIG. 6, including a seventeenth refrigerant leak detector, an eighteenth refrigerant leak detector, a nineteenth refrigerant leak detector, a twentieth refrigerant leak detector, a twenty first refrigerant leak detector, a twenty second refrigerant leak detector, and a twenty third refrigerant leak detector (e.g., used in addition to or in lieu of one or more other refrigerant leak detector[s] in FIGS. 8-16) of the refrigerant leak detection assembly, in accordance with an aspect of the present disclosure;

FIG. 18 is an isometric view of a portion of an embodiment of the RTU of FIG. 5, including a first refrigerant leak detector, a second refrigerant leak detector, a third refrigerant leak detector, a fourth refrigerant leak detector, a fifth refrigerant leak detector, a sixth refrigerant leak detector, and a seventh refrigerant leak detector of the refrigerant leak detection assembly, in accordance with an aspect of the present disclosure;

FIG. 19 is an isometric view of a portion of the RTU of FIG. 18, including an eighth refrigerant leak detector, a ninth refrigerant leak detector, and a tenth refrigerant leak detector (e.g., used in addition to or in lieu of one or more other refrigerant leak detector[s] in FIG. 18) of the refrigerant leak detection assembly, in accordance with an aspect of the present disclosure;

FIG. 20 is an isometric view of a portion of the RTU of FIG. 5, including a first refrigerant leak detector, a second refrigerant leak detector, and a third refrigerant leak detector of the refrigerant leak detection assembly, in accordance with an aspect of the present disclosure;

FIG. 21 is an isometric view of a portion of an RTU of FIG. 20, including a fourth refrigerant leak detector and a fifth refrigerant leak detector (e.g., used in addition to or in lieu of one or more other refrigerant leak detector[s] in FIG. 20) of the refrigerant leak detection assembly, in accordance with an aspect of the present disclosure;

FIG. 22 is an isometric view of a portion of the RTU of FIG. 20, including a sixth refrigerant leak detector, a seventh refrigerant leak detector, an eighth refrigerant leak detector, a ninth refrigerant leak detector, and a tenth refrigerant leak detector (e.g., used in addition to or in lieu of one or more other refrigerant leak detector[s] in FIGS. 20 and 21) of the refrigerant leak detection assembly, in accordance with an aspect of the present disclosure;

FIG. 23 is an isometric view of a portion of the RTU of FIG. 5, including a first refrigerant leak detector, a second refrigerant leak detector, and a third refrigerant leak detector of the refrigerant leak detection assembly, in accordance with an aspect of the present disclosure;

FIG. 24 is an isometric view of a portion of the RTU of FIG. 23, including a fourth refrigerant leak detector and a fifth refrigerant leak detector (e.g., used in addition to or in lieu of one or more other refrigerant leak detector[s] in FIG. 23) of the refrigerant leak detection assembly, in accordance with an aspect of the present disclosure;

FIG. 25 is an isometric view of a portion of the RTU of FIG. 23, including a sixth refrigerant leak detector, a seventh refrigerant leak detector, an eighth refrigerant leak detector, and a ninth refrigerant leak detector (e.g., used in addition to or in lieu of one or more other refrigerant leak detector[s] in FIGS. 23 and 24) of the refrigerant leak detection assembly, in accordance with an aspect of the present disclosure;

FIG. 26 is an isometric view of a portion of the RTU of FIG. 5, including a first refrigerant leak detector, a second first refrigerant leak detector, and a third second refrigerant leak detector of the refrigerant leak detection assembly, in accordance with an aspect of the present disclosure; and FIG. 27 is an isometric view of a portion of the RTU of FIG. 26, including a fourth refrigerant leak detector (e.g., used in addition to or in lieu of one or more other refrigerant leak detector[s] in FIG. 26) of the refrigerant leak detection assembly, in accordance with an aspect of the present disclosure.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

The present disclosure relates to a refrigerant leak detection assembly (e.g., arrangement) of a heating, ventilation, and/or air conditioning (HVAC) system, such as a rooftop unit (RTU). More particularly, the present disclosure relates to locations of refrigerant leak detectors (e.g., sensors, such as refrigerant concentration sensors, thermal sensors, and/or other types of refrigerant leak detection sensors) within the HVAC system (e.g., RTU). For example, HVAC systems in accordance with the present disclosure may include low Global Warming Potential (GWP) refrigerants, such as A2L refrigerants, as a heat transfer medium (e.g., working fluid). Because low GWP refrigerants (e.g., A2L refrigerants) may be flammable, among other reasons, HVAC systems employing low GWP refrigerants (e.g., A2L refrigerants) may benefit from refrigerant leak detection assemblies (e.g., refrigerant leak detectors) configured to detect refrigerant leaked from a refrigerant loop or circuit (e.g., vapor compression loop or circuit) of the HVAC system (e.g., RTU). As described in detail below, presently disclosed locations of the refrigerant leak detectors enable the refrigerant leak detection assembly to detect the refrigerant leak relatively accurately, relatively reliably, and relatively quickly (e.g., within 5 minutes of the refrigerant leak occurring). Presently disclosed locations may additionally or alternatively protect componentry of the HVAC system (e.g., RTU), such as electronic componentry, from negative effects caused by contact of the low GWP refrigerant (e.g., A2L refrigerant) therewith. These and other aspects of the present disclosure are described in detail below with reference to the drawings.

Figure 1:
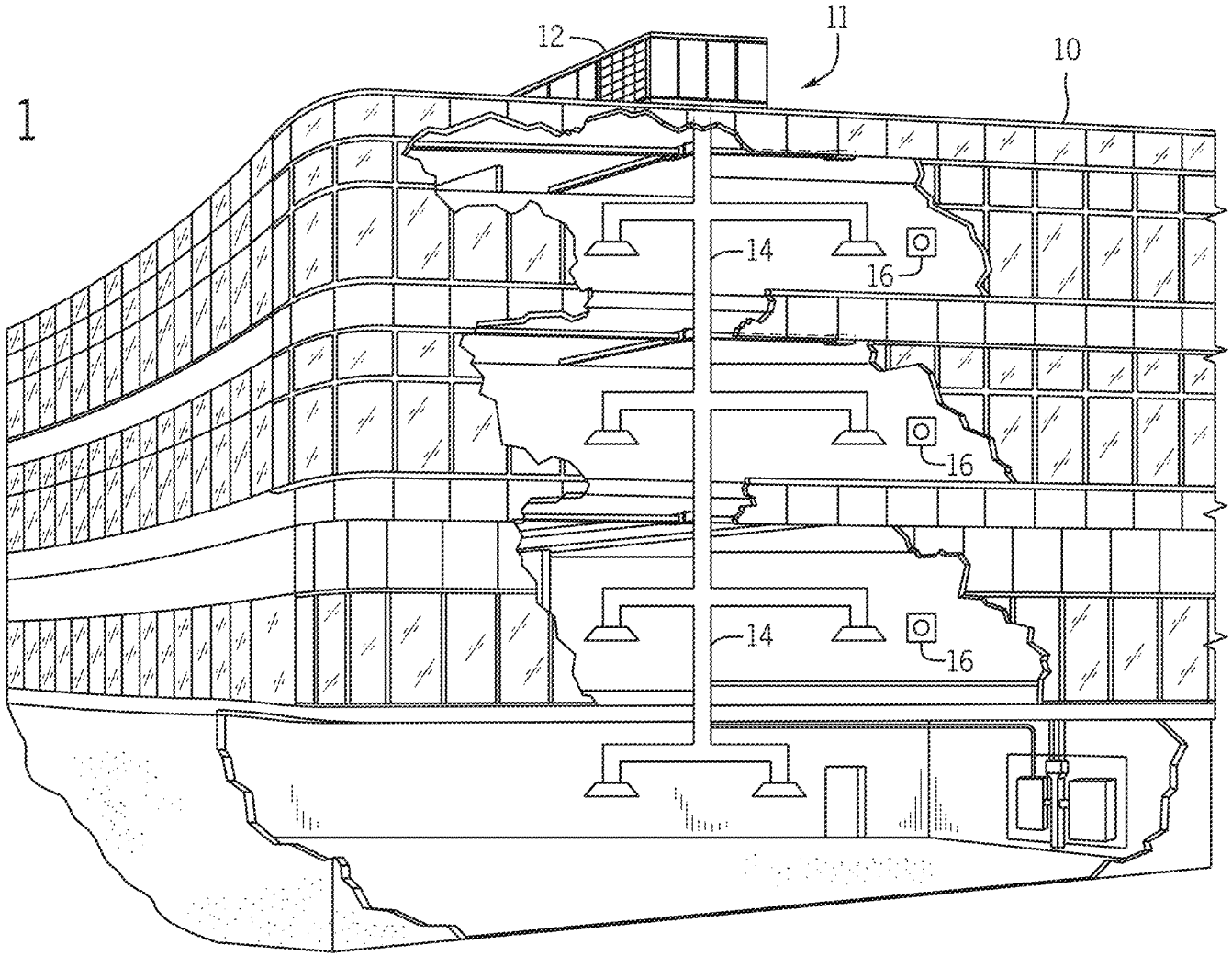
FIG. 1 is a schematic view of an embodiment of an HVAC system for building environmental management that includes an HVAC unit, in accordance with an aspect of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan or blower, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

To help illustrate, a building 10 serviced by a heating, ventilating, and air conditioning (HVAC) system 11 is shown in FIG. 1. In some embodiments, the building 10 may be a commercial structure or a residential structure. Additionally, the HVAC system 11 may include equipment, such as one or more HVAC units 12 and/or one or more furnaces, that operates to produce temperature-controlled air, which may be supplied to internal spaces within the building via ductwork 14. As shown, the HVAC unit 12 is disposed on the roof of the building 10; however, the HVAC unit 12 may be located in other equipment rooms or areas adjacent the building 10.

To facilitate controlling operation of the HVAC equipment, the HVAC system 11 may include a control system. In some embodiments, the control system may be implemented using one or more control devices 16, such as a thermostat, a zone sensor, a zone control board, a pressure transducer, and/or a temperature transducer. For example, a control device 16 may be a thermostat used to designate target air conditions, such as target temperature and/or target humidity level, within the building 10 and/or that measures air conditions present within the building 10.

To facilitate achieving the target air conditions, the control system may control operation of the HVAC unit 12 and/or other HVAC equipment, such as fans or air dampers disposed in the ductwork 14, based at least in part on the target air conditions and measured air conditions. For example, when the difference between the measured temperature and the target temperature is greater than a threshold, the control system may turn on or run the HVAC unit 12 to circulate refrigerant through one or more heat exchangers to facilitate producing temperature-controlled air. Additionally, the control system may turn on a fan and/or adjust position of an air damper to facilitate supplying the temperature-controlled air to internal spaces within the building 10 via the ductwork 14.

To facilitate producing temperature-controlled air, in some embodiments, the HVAC unit 12 may be selectively operated in different modes, such as a first-stage cooling mode, a second-stage cooling mode, a fan only mode, a first-stage heating mode, and a second-stage heating mode. For example, when operating in a heating mode or heat pump mode, the HVAC unit 12 may inject heat to produce heated air, which may then be supplied to internal spaces within the building 10. Additionally, or alternatively, the HVAC system 11 may include a furnace that operates to produce the heated air. Furthermore, when operating in a cooling mode or air conditioning mode, the HVAC unit 12 may extract heat to produce cooled air, which may then be supplied to internal spaces within the building 10.

In some embodiments, the HVAC system 11 may be a split HVAC system, for example, which includes an outdoor HVAC unit and an indoor HVAC unit. Additionally, or alternatively, an HVAC unit 12 may be a single package unit that includes other equipment, such as a blower, a fan, an integrated air handler, and/or an auxiliary heating unit. For example, in the depicted embodiment, the HVAC unit 12 is a rooftop unit (RTU) that conditions a supply air stream, such as environmental air and/or a return air flow from the building 10.

Figure 2:
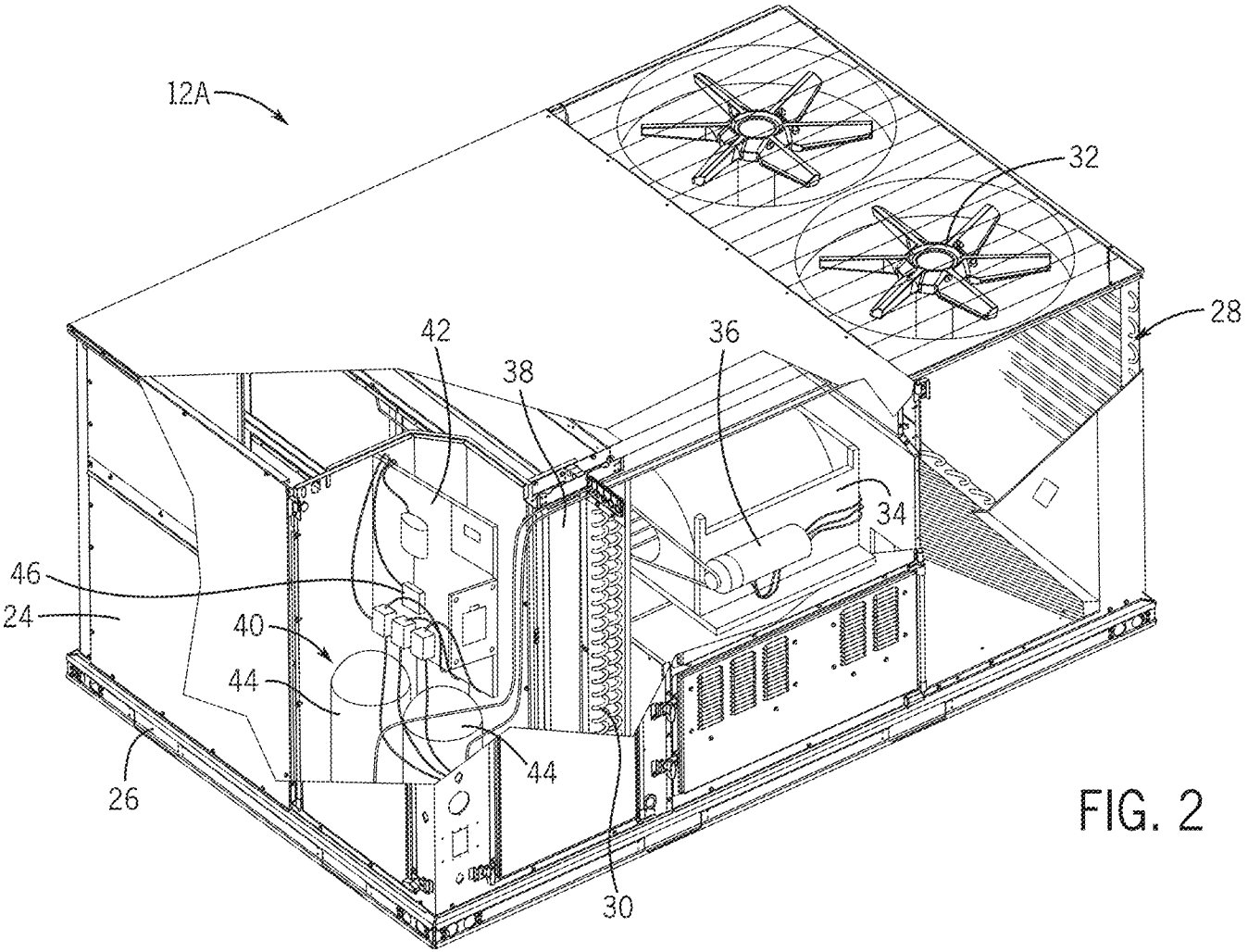
FIG. 2 is a perspective view of an embodiment of an HVAC unit that may be used in the HVAC system of FIG. 1, in accordance with an aspect of the present disclosure.

To help illustrate, an example of a single package HVAC unit 12A is shown in FIG. 2. As depicted, the HVAC unit 12A includes a housing 24, rails 26, an environment heat exchanger 28, a supply air heat exchanger 30, one or more fans 32, a blower assembly 34, a motor 36, one or more filters 38, a compressor 40, and a control board 42, which may be communicatively coupled to or included in the HVAC control system. In some embodiments, the housing 24 may enclose the HVAC unit 12 to provide structural support and/or to protect to internal components from environmental and/or other contaminants. Additionally, in some embodiments, the housing 24 may be constructed of galvanized steel and insulated with aluminum foil faced insulation.

Furthermore, as in the depicted embodiment, rails 26 may be joined to the bottom perimeter of the housing 24 to provide a foundation for the HVAC unit 12A. For example, the rails 26 may provide access for a forklift and/or overhead rigging to install and/or remove the HVAC unit 12. Additionally, in some embodiments, the rails 26 may fit into "curbs," for example, implemented on the roof of the building 10 to enable the HVAC unit 12 to provide air to the ductwork 14 while blocking contaminants, such as rain, from leaking into the building 10.

As will be described in more detail below, the environment heat exchanger 28 and the supply air heat exchanger 30 may be included in a refrigerant circuit (e.g., loop) that operates to circulate refrigerant. In particular, the environment heat exchanger 28 and the supply air heat exchanger 30 may each include tubing through which the refrigerant is circulated to facilitate heat exchange between the refrigerant and air. In some embodiments, the tubing may include multichannel tubing, copper tubing, aluminum tubing, and/or the like.

In other words, the environment heat exchanger 28 and the supply air heat exchanger 30 may implement a thermal cycle in which the refrigerant undergoes phase changes and/or temperature changes as it flows through the environment heat exchanger 28 and the supply air heat exchanger 30 to produce heated air and/or cooled air. For example, when operating in a cooling mode, the environment heat exchanger 28 may function as a condenser to extract heat from the refrigerant and the supply air heat exchanger 30 may function as an evaporator to use the refrigerant to extract heat from the air to be supplied to internal spaces within the building 10. On the other hand, when operating in a heating mode, the environment heat exchanger 28 may function as an evaporator to inject heat into the refrigerant and the supply air heat exchanger 30 may function as a condenser to inject heat from the refrigerant into the air to be supplied to internal spaces within the building 10.

To facilitate heat exchange, during operation, the fans 32 may draw environmental or outside air through the environment heat exchanger 28. In this manner, the environmental air may be used to heat and/or cool as the refrigerant as it flows through the tubing of the environment heat exchanger 28. Additionally, a blower assembly 34, powered by a motor 36, may draw air to be supplied to internal portions of the building 10 through the supply air heat exchanger 30. In some embodiments, the supply air may include environmental air, outside air, return air, inside air, or any combination thereof. In any case, in this manner, the refrigerant may be used to heat and/or cool the supply air as it flows through the tubing of the supply air heat exchanger 30.

In some embodiments, the HVAC unit 12 may flow supply air through one or more air filters 38 that remove particulates and/or other air contaminants from the supply air. For example, one or more air filters 38 may be disposed on an air intake side of the supply air heat exchanger 30 to reduce likelihood of contaminants contacting tubing of the supply air heat exchanger 30. Additionally, or alternatively, one or more air filters 38 may be disposed on an air output side of the HVAC unit 12A to reduce likelihood of contaminants being supplied to internal spaces within the building 10.

The HVAC unit 12 also may include other HVAC equipment, such as a compressor 40, a solid-core filter drier, a drain pan, a disconnect switch, an economizer, pressure switches, and/or the like. In some embodiments, the compressor 40 may be a scroll compressor, a rotary compressor, a screw compressor, or a reciprocating compressor. Additionally, in some embodiments, the compressor 40 may be implemented using multiple selectable compressor stages 44. For example, in the depicted embodiment, the compressor 40 is implemented in a dual stage configuration with two compressor stages 44.

In this manner, an HVAC system 11 may be implemented with one or more single package HVAC units 12A. As described above, in other embodiments, an HVAC system 11 may be a split HVAC system. In such embodiments, instead of a single package HVAC unit 12A, the HVAC system 11 may be implemented with split HVAC units, such as an outdoor HVAC unit and an indoor HVAC unit.

Figure 3:
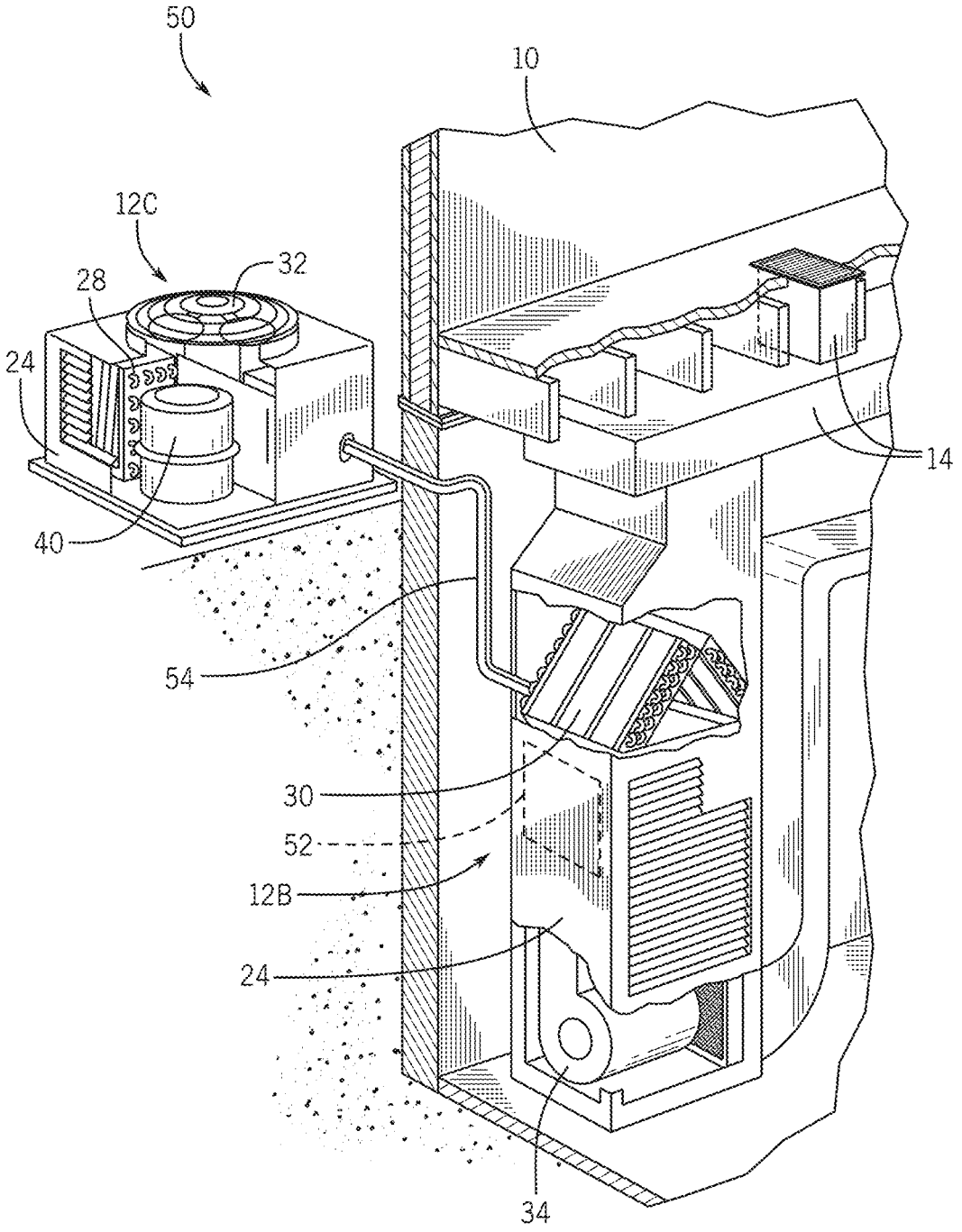
FIG. 3 is a cutaway perspective view of an embodiment of a split, residential HVAC system, in accordance with an aspect of the present disclosure.

To help illustrate, an example of a portion 50 of an HVAC system 11, which includes an indoor HVAC unit 12B and an outdoor HVAC unit 12C, is shown in FIG. 3. As depicted, the outdoor HVAC unit 12C may be implemented outside of the building 10, for example, adjacent a side of the building 10 and covered by a shroud or housing 24 to protect the system components from debris and/or other contaminants. On the other hand, the indoor HVAC unit 12B may be implemented inside the building 10, for example, in a utility room, an attic, a basement, or the like.

Additionally, as depicted, the outdoor HVAC unit 12C includes an environment heat exchanger 28 and a fan 32. As discussed above, in some embodiments, the environment heat exchanger 28 may function as a condenser when in a cooling mode and as an evaporator when in a heating mode.

Furthermore, as depicted, the indoor HVAC unit 12B includes a supply air heat exchanger 30 and a blower assembly 34. In some embodiments, the indoor HVAC unit 12B may also include a furnace 52, for example, when HVAC system 11 is not implemented to operate in a heat pump mode. In such embodiments, the furnace 52 may combust fuel, such as natural gas, to produce a combustion product, which may be flowed through tubing of a separate heat exchanger to facilitate injecting heat from the combustion product into supply air to be routed through ductwork 14 of the building 10.

In some embodiments, the supply air heat exchanger 30 may function as an evaporator when in a cooling mode and as a condenser when in a heating mode. Thus, as depicted, the indoor HVAC unit 12B and the outdoor HVAC unit 12C may be fluidly coupled via one or more refrigerant conduits 54 to form a refrigerant circuit (e.g., loop), for example, typically transferring primarily liquid refrigerant in one direction and primarily vaporized refrigerant in the opposite direction.

Figure 4:
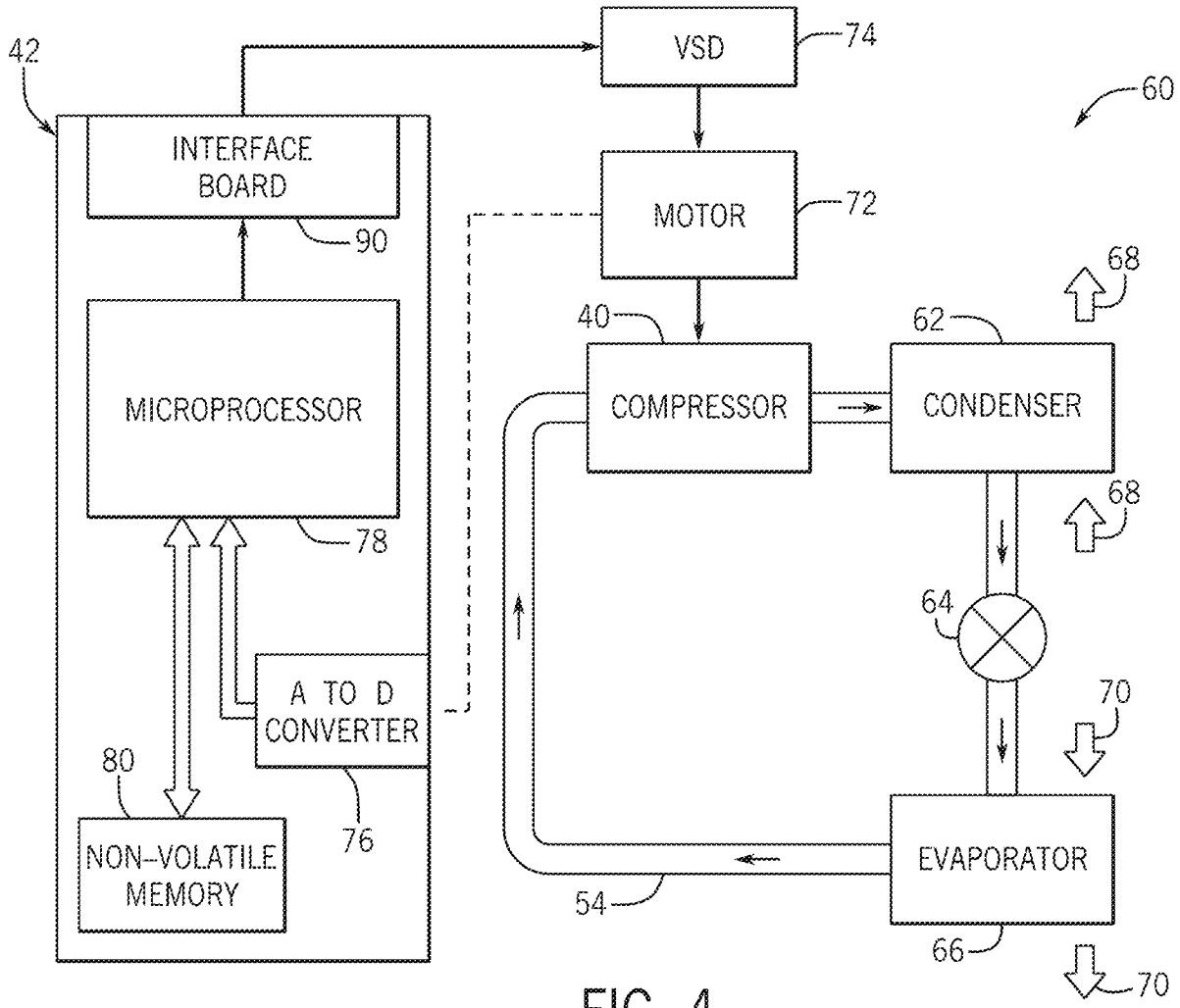
FIG. 4 is a block diagram of an embodiment of a refrigerant loop that may be implemented in the HVAC system of FIG. 1, in accordance with an aspect of the present disclosure.

To help illustrate, an example schematic of a portion 60 of an HVAC unit 12 is shown in FIG. 4. As depicted, the HVAC unit 12 includes a compressor 40, a condenser 62, one or more expansion devices 64 or valves, and an evaporator 66. As described above, the condenser 62 and/or the evaporator 66 may each be implemented using one or more heat exchangers. In any case, actuation of the compressor 40 generally drives circulation of refrigerant through the refrigerant conduits 54. In particular, the compressor 40 may receive refrigerant vapor from the evaporator 66, compress the refrigerant vapor, and output the compressed refrigerant vapor to the condenser 62.

As the refrigerant flows through the condenser 62, a first air flow 68 may be used to extract heat from refrigerant to facilitate condensing the vapor into liquid. When operating in a cooling mode, the first air flow 68 may be produced using environmental or outside air, for example, by actuating a fan 32. On the other hand, when operating in a heating mode, the first air flow 68 may be produced using supply air, for example, by actuating a blower assembly 34. Before being supplied to the evaporator 66, the refrigerant may flow through one or more expansion devices 64 to facilitate reducing pressure.

As the refrigerant flows through the evaporator 66, the refrigerant may undergo a phase change from liquid to vapor that facilitates extracting heat from a second air flow 70. When operating in a cooling mode, the second air flow 70 may be produced using supply air, for example, by actuating a blower assembly 34. On the other hand, when operating in a heating mode, the second air flow 70 may be produced using environmental or outside air, for example, by actuating a fan 32. Thereafter, the refrigerant may be circulated back to the compressor 40.

As depicted, the compressor 40 may be actuated by a motor 72 during operation. In some embodiments, the motor 72 may be a switched reluctance motor, an induction motor, an electronically commutated permanent magnet motor, and/or another suitable electromechanical motor. In other words, the motor 72 may actuate the compressor 40 when electrical power is supplied to the motor 72.

To facilitate controlling supply of electrical power to the motor 72, a variable speed drive (VSD) 74 and/or a control board 42 may be coupled to the motor 72. In particular, the variable speed drive 74 may receive alternating current (AC) electrical power having a fixed line voltage and a fixed line frequency from a power source, such as an electrical grid. Additionally, the control board 42 may control operation of the variable speed drive 74 to supply alternating current (AC) electrical power with a variable voltage and/or a variable frequency to the motor 72, for example, by controlling switching devices implemented in the variable speed drive 74. In other embodiments, the motor 72 may be powered directly from an AC power source or a direct current (DC) power source, such as a battery.

To facilitate controlling operation of the variable speed drive 74 or motor 72, as in the depicted embodiment, the control board 42 may include an analog to digital (A/D) converter 76, a microprocessor 78, non-volatile memory 80, and an interface 82. For example, to control switching in the variable speed drive 74, the microprocessor 78 may execute instructions stored in a tangible, non-transistor, computer readable medium, such as the non-volatile memory 80, to determine control signals or commands, which may be communicated to the variable speed drive 74 via the interface 82. Additionally, the control board 42 may control switching in the variable speed drive 74 based at least in part on feedback from the motor 72 and/or other sensors, for example, as analog electrical signals, which may be converted to digital data via the analog to digital (A/D) converter 76 before processing by the microprocessor 78.

In any case, it should be appreciated that any of the features described herein may be incorporated with the HVAC unit 12, a residential heating and cooling system, or other HVAC system. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications. In accordance with the present disclosure, any of the aforementioned HVAC systems, such as an RTU, may include a refrigerant leak detection assembly including various refrigerant leak detectors (e.g., sensors) configured to detect refrigerant leaked from a refrigerant loop or circuit (e.g., vapor compression loop or circuit) thereof. The refrigerant leak detectors (e.g., sensors) are selectively positioned within the HVAC system (e.g., RTU) to improve upon a timing and/or accuracy of refrigerant leak detection over traditional configurations. As an example, a refrigerant leak detector selectively positioned in any of the locations described in greater detail below may be configured to accurately detect a refrigerant leak within 5 minutes of the refrigerant leak occurring.

FIG. 5 is a block diagram of an embodiment of a rooftop unit (RTU) 100 having a refrigerant leak detection assembly 102 (or "arrangement"). Other possible features of various embodiments of the RTU 100 (e.g., besides the refrigerant leak detection assembly 102) will be described in greater detail with reference to later drawings. Further, while certain refrigerant leak detection assembly features of the present disclosure are described with reference to an RTU, it should be understood that the present disclosure encompasses other types of HVAC systems (e.g., single package units, residential units, split units, a combination thereof, and/or other types of HVAC systems) with the same or similar refrigerant leak detection assembly features.

In the illustrated embodiment, the refrigerant leak detection assembly 102 includes refrigerant leak detectors 104, such as refrigerant leak sensors (e.g., refrigerant concentration sensors, thermal sensors, other types of sensors configured to detect a refrigerant leak, etc.) configured to detect refrigerant (e.g., low GWP refrigerant, such as A2L refrigerant) leaked from a portion of the RTU 100, such as from a refrigerant loop or circuit (e.g., vapor compression loop or circuit) thereof. The refrigerant leak detection assembly 102 also includes a controller 106 (including one or more controller components) in communication (e.g., wired or wireless communication) with the refrigerant leak detectors 104.

As shown, the controller 106 may include control circuitry 108, such as processing circuitry 110, memory circuitry 112, and an analog-to-digital (A-D) converter 114, among other possibly componentry. The controller 106 may also include a database 116 in certain embodiments, while in some embodiments, the database 116 is separate from the controller 106 and the controller 106 accesses the database 116 via wired or wireless communication techniques. The processing circuitry 110 may be implemented as a general-purpose processor, an application specific integrated circuit (ASIC), one or more field programmable gate arrays (FPGAs), a group of processing components, or other suitable electronic processing components.

The memory circuitry 112 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. Additionally or alternatively, the memory circuitry 112 may be or include volatile memory or non-volatile memory. Additionally or alternatively, the memory circuitry 112 may include database components, object code components, script components, or any other type of information structure for supporting the various activities and information structures described in the present application. According to some embodiments, the memory circuitry 112 is communicably connected to the processing circuitry 110 and includes computer code for executing one or more processes described herein.

In some embodiments, the controller 106 is provided in a control board (e.g., the control board 42 in FIGS. 2 and 4) of the HVAC equipment (e.g., the RTU 100). Although the control board 42 is shown proximal to the compressor 40 in FIG. 2, for example, the control board 42 can be placed at any other suitable location. In some embodiments, structure, logic, and/or functionality of the controller 106 may be embedded in the control board 42. Additionally or alternatively, the controller 106 may be provided in a separate control box which can be positioned within the HVAC equipment or distant from the HVAC equipment. For example, the processing circuitry 110 or the database 116 may be provided in a cloud-based server, whereas other components may be provided in or near the HVAC equipment (e.g., RTU 100).

As described above, the controller 106 and the refrigerant leak detectors 104 may be in wired or wireless communication with one another, such that the refrigerant leak detectors 104 may transmit sensor feedback (e.g., leak detection signals and/or data) via wired or wireless communication to the controller 106. For example, the controller 106 and the refrigerant leak detectors 104 may communicate with each other using a wireless technique including, but not limited to, Bluetooth technology, Wireless Fidelity (Wi-Fi), mobile communication technology, Infrared communication, etc. Suitable modules may be provided with the refrigerant leak detectors 104 and the controller 106 to facilitate wireless communication therebetween. In some embodiments, the controller 106 may include the A-D converter 116 for converting analog electrical signals received from the refrigerant leak detectors 104 to digital data before processing by the processing circuitry 110.

As described in greater detail below with reference to later drawings, the refrigerant leak detectors 104 (e.g., sensors) may be selectively distributed about various locations within the RTU 100. Locations of the refrigerant leak detectors 104 in accordance with the present disclosure may enable relatively accurate, fast, and reliable refrigerant leak detection. For example, locations of the refrigerant leak detectors 104 in accordance with the present disclosure may enable refrigerant leak detection within 5 minutes of the refrigerant leak occurring, may detect refrigerant leaks proximate critical locations of the RTU 100, etc. Additionally or alternatively, locations of the refrigerant leak detectors 104 may be configured to protect certain componentry of the RTU 100, such as electronic componentry, from negative effects that may otherwise occur when said componentry is contacted by unidentified leaked refrigerant. Additionally or alternatively, locations of the refrigerant leak detectors 104 may be configured to ensure identification of a refrigerant leak prior to the refrigerant leak reaching a space conditioned by the HVAC system (e.g., the RTU 100).

In some embodiments, the controller 106 is configured to determine, based on sensor feedback from the refrigerant leak detectors 104, an extent and/or location of the leaked refrigerant, an extent and/or location of the refrigerant leak, or both. In response to identifying a refrigerant leak and information associated with the refrigerant leak, the controller 106 may perform one or more actions, such as transmitting an alert (e.g., to a user interface 118 of the RTU 100 and/or to a separate device, such as a smart phone, a computer, a tablet, a server, cloud storage, etc.), controlling operation of a component (e.g., a compressor, an expansion valve, a blower or fan, a damper, etc.) of the RTU 100, etc. Controlling operation of the component may include, for example, changing a setting of the component, stopping operation of the component, initiating operation of the component, or any combination thereof.

FIG. 5, described in detail above, is a block diagram of one example of the RTU 100 having the refrigerant leak detectors 104 (e.g., sensors) and control componentry. FIGS. 6-17 illustrate a first embodiment of the RTU 100 of FIG. 5, while FIGS. 18 and 19 illustrate a second embodiment of the RTU 100 of FIG. 5, FIGS. 20-22 illustrate a third embodiment of the RTU 100 of FIG. 5, FIGS. 23-25 illustrate a fourth embodiment of the RTU 100 of FIG. 5, and FIGS. 26 and 27 illustrate a fifth embodiment of the RTU 100 of FIG. 5. For purposes of clarity, the first embodiment of the RTU 100 is labeled with reference numeral 200 in FIGS. 6-17 (and includes refrigerant leak detectors labeled 204 of refrigerant leak detection assembly labeled 202), the second embodiment of the RTU 100 is labeled with reference numeral 400 in FIGS. 18 and 19 (and includes refrigerant leak detectors labeled 404 of refrigerant leak detection assembly labeled 402, the third embodiment of the RTU 100 is labeled with reference numeral 500 in FIGS. 20-22 (and includes refrigerant leak detectors labeled 504 of refrigerant leak detection assembly labeled 502), the fourth embodiment of the RTU 100 is labeled with reference numeral 600 in FIGS. 23-25 (and includes refrigerant leak detectors 604 of refrigerant leak detection assembly labeled 602), and the fifth embodiment of the RTU 100 is labeled with reference numeral 700 in FIGS. 26 and 27 (and includes refrigerant leak detectors 704 of refrigerant leak detection assembly 702).

It should be understood that the present disclosure encompasses embodiments having certain features in one embodiment (e.g., the first embodiment illustrated in FIGS. 6-17) and certain features in another embodiment (e.g., the second embodiment illustrated in FIGS. 18 and 19). Any such suitable combination of any such suitable features is contemplated herein. Further, while the controller 106 in FIG. 5 is not labeled in FIGS. 6-27, it should be understood that the controller 106 is included in such embodiments. As previously described, certain instances of the present disclosure reference refrigerant leak detection features with respect to an RTU, although it should be understood that the same or similar refrigerant leak detection features may be applicable to other types of HVAC systems.

Figure 7:
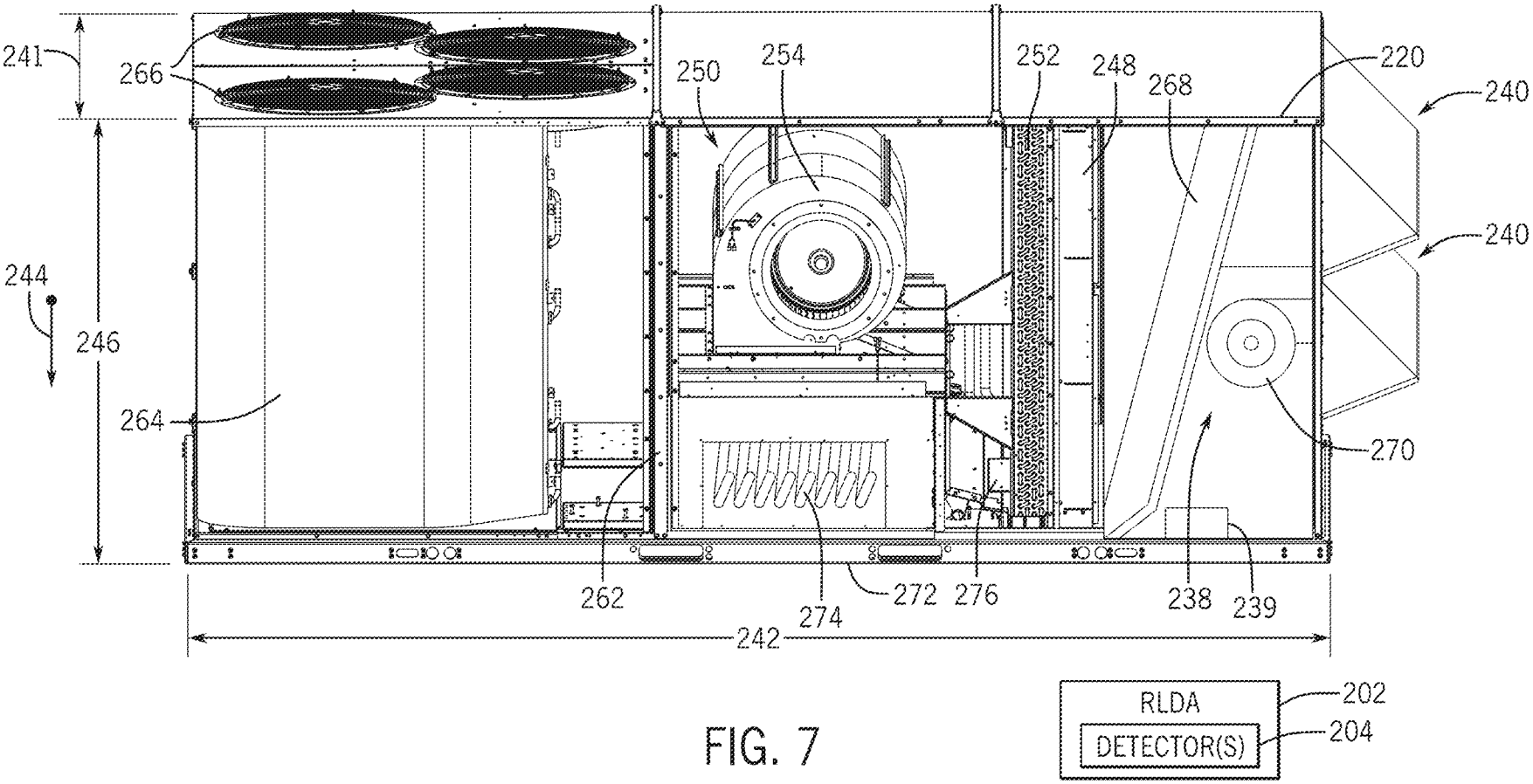
FIG. 7 is a perspective view of the RTU of FIG. 6, including the refrigerant leak detection assembly, in accordance with an aspect of the present disclosure.

FIG. 6 is an isometric view of an embodiment of the RTU 200, including the refrigerant leak detection assembly 202 having the refrigerant leak detectors 204 (e.g., sensors). That is, the RTU 200 in FIG. 6 is an embodiment of the RTU 100 in FIG. 5. Further, FIG. 7 is a perspective view of the RTU 200 of FIG. 6, including the refrigerant leak detection assembly 202 having the refrigerant leak detectors 204 (e.g., sensors). FIG. 7 is from a view of the RTU 200 opposing the view illustrated in FIG. 6. While the refrigerant leak detection assembly 202 including the refrigerant leak detectors 204 is schematically illustrated as blocks in FIGS. 6 and 7, it should be understood that, in practice, the refrigerant leak detectors 204 are selectively distributed about the RTU 200. Specific locations of the refrigerant leak detectors 204 of the RTU 200 in FIGS. 6 and 7 will be illustrated in, and described in greater detail with respect to, FIGS. 8-17.

Referring first to FIG. 6, the RTU 200 includes a housing 220 and a control board 222 positioned in the housing 220. The control board 222 may include electronic circuitry and controllers for controlling devices (e.g., a compressor, a condenser, an evaporator, a damper, a blower, etc.) provided in the housing 220. In some embodiments, the control board 222 includes some or all of the componentry of the controller 106 illustrated in FIG. 5. As shown, the control board 222 may be disposed in a control box 224 (e.g., a chamber, a control box chamber) defined in part by the housing 220 and/or in part by interior panels 226, 228, 230 (e.g., walls) disposed within the housing 220. In some embodiments, the control box 224 is bifurcated (e.g., separated, divided) into a low voltage compartment 232 receiving low voltage components and a high voltage compartment 234 receiving high voltage components, where the low voltage compartment 232 and the high voltage compartment 234 are separated at least in part by a bifurcating panel 236 (e.g., a wall). The control board 222 may be distributed between the high voltage compartment 234 and the low voltage compartment 232 in certain embodiments, or the control board 222 may be disposed in one or the other.

The RTU 200 also includes a return air chamber 238 (e.g., a return air section, a return air compartment, etc.) fluidly coupled a return air inlet 239 illustrated in FIG. 7. The return air chamber 238 may also include a fresh air inlet 240 illustrated in FIG. 9 for allowing fresh air to enter the housing 220. In some embodiments, as shown in FIGS. 6 and 7, the control board 222 and the return air chamber 238 may be positioned side-by-side along a width 241 of the housing 220 (e.g., where the width 241 and a length 242 of the housing 220 extend transverse to a gravity vector 244, the length 242 is greater than the width 241, and a height 246 of the housing 220 extends substantially parallel to the gravity vector 244).

One or more filters 248 (e.g., a filter assembly) may be provided in the housing 220 for filtering return air and/or fresh air received in the housing 220. For example, the filters 248 may extend between return air chamber 238 and a blower chamber 250 (e.g., an air flow chamber) defined in the housing 220. Further, a first heat exchanger, such as an evaporator 252, is provided in the housing 220 for cooling air to be supplied to a conditioned space. The RTU 200 further includes one or more blowers 254 provided with a variable frequency drive (VFD) 256 and a motor 258 labeled in FIG. 6, where the one or more blowers 254 and the corresponding VFD(s) 256 and motor(s) 258 are disposed in the blower chamber 250. The blowers 254 create an airflow to draw air through the return air chamber 238 and supply conditioned air (e.g., after passing over the evaporator 252). In some embodiments, the evaporator 252 is at least partially enclosed within an evaporator chamber 260 in the housing 220. It should be understood that, in general, the various chambers within the housing 220 of the RTU 200 may be separated (e.g., partially or wholly separated) from each other via interior panels of the RTU 200, as previously described.

The RTU 200 further includes a compressor 262, a second heat exchanger (e.g., a condenser 264 illustrated in FIG. 7), and condenser fans 266 provided proximal to each other. The RTU 200 may also include, in certain embodiments and as illustrated in FIG. 7, an economizer 268 and a powered exhaust 270. The housing 220 may include rails 272 provided at a base perimeter of the housing 220, as shown. Further still, the RTU 200 may include a gas heat exchanger 274 illustrated in FIG. 7 and provided to supply heat to a conditioned air, if required. In some embodiments, the gas heat exchanger 274 is provided proximal to the evaporator 252 and separated from the evaporator 252 (e.g., the evaporator chamber 260) via a partition 276. Preferably, the gas heat exchanger 274 is provided below the blower(s) 254 such that air exiting the blower(s) 254 passes over the gas heat exchanger 274. It is to be noted that positioning of components of the RTU 200 described herein is only for explanation purposes, and the present disclosure is not limited to the aforementioned positions of said components. The components can be arranged in any other suitable way in other embodiments. As previously described, the refrigerant leak detector(s) 204 of the refrigerant leak detection assembly 202 may be selectively distributed through various portions of the RTU 200 to improve upon an accuracy, a timeliness, and/or a reliability of refrigerant leak detection relative to traditional configurations.

FIGS. 8-17, described in detail below, illustrate various locations of the refrigerant leak detector(s) 204 (e.g., sensors) in accordance with the present disclosure. It should be noted that use of "first," "second," "third," "fourth," etc. with respect to various ones of the refrigerant leak detector (s) 204 is merely to distinguish between the refrigerant leak detector(s) 204 and various locations thereof, and should not be taken to imply that the refrigerant leak detection assembly 202 necessarily includes all of the refrigerant leak detector(s) 204 illustrated in, and described with respect to, FIGS. 8-17. For example, certain embodiments may include only a subset of all the refrigerant leak detector(s) 204 illustrated in, and described with respect to, FIGS. 8-17 (e.g., one embodiment may include only the "first" refrigerant leak detector 204, another embodiment may include only the "first" and "second" refrigerant leak detectors 204, another embodiment may include only the "first" and "third" refrigerant leak detectors 204, another embodiment may include only the "first," "second," and "fourth" refrigerant leak detectors 204, etc.). Any suitable combination of the refrigerant leak detectors 204 described with respect to FIGS. 8-17 below is possible in accordance with the present disclosure.

Figure 8:
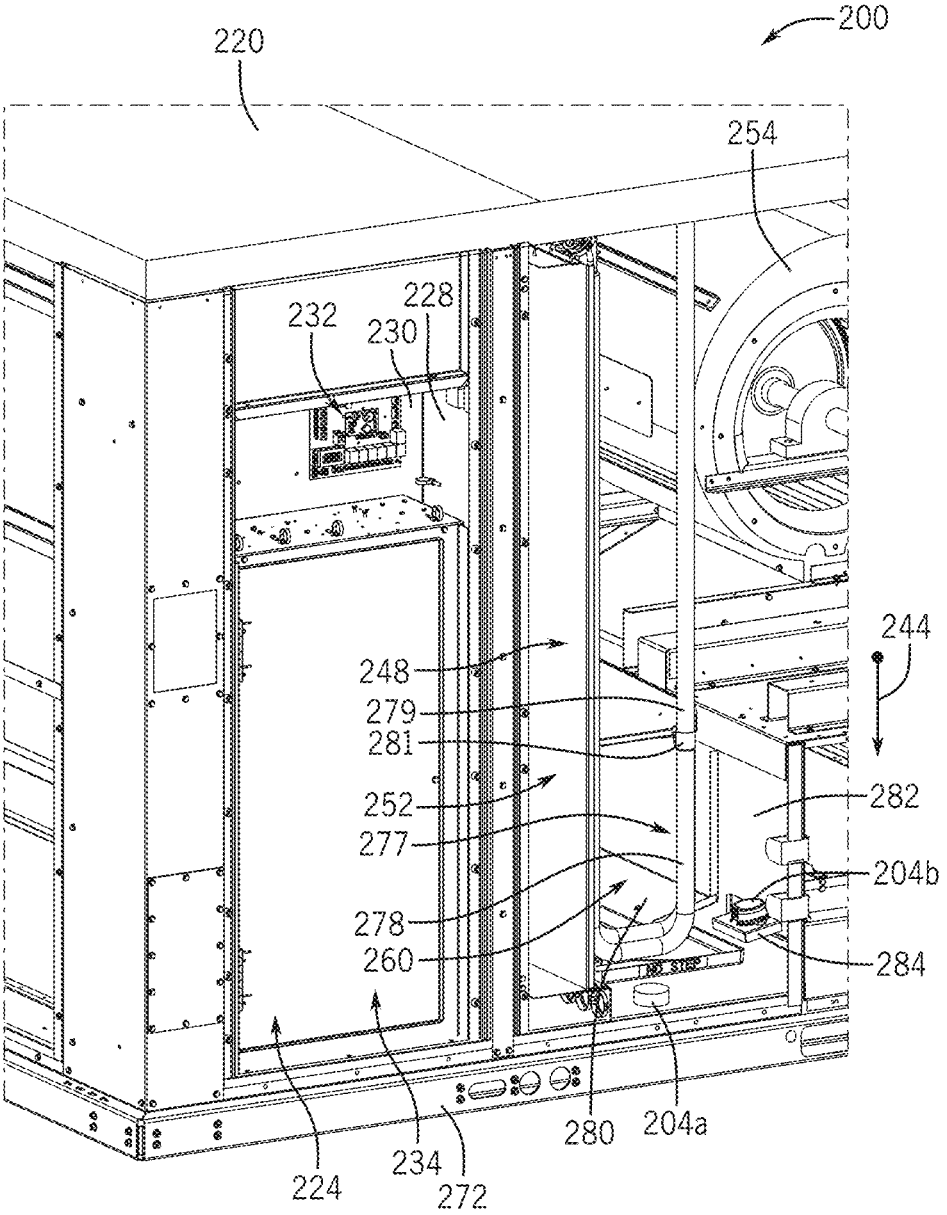
FIG. 8 is an isometric view of a portion of the RTU of FIG. 6, including a first refrigerant leak detector and a second refrigerant leak detector of the refrigerant leak detection assembly, in accordance with an aspect of the present disclosure.

FIG. 8 is an isometric view of a portion of the RTU 200 of FIG. 6, including a first refrigerant leak detector 204*a* and a second refrigerant leak detector 204*b* of the refrigerant leak detection assembly 202. Certain of the componentry labeled and described with respect to FIGS. 6 and 7 may be labeled in FIG. 8, but some of said componentry may not be described in detail below. In the illustrated embodiment, the RTU 200 includes a fluid conduit 277 including a first portion 278 (e.g., having a first material), a second portion 279 (e.g., having a second material different than the first material), and a brazed joint 281 between the first portion 278 and the second portion 279, where the fluid conduit 277 is configured to convey the refrigerant through the RTU 200, such as to and/or from the evaporator 252. Although the evaporator 252 is not shown in its entirety in FIG. 8, a location of the evaporator 252 is marked in FIG. 8 and the evaporator 252 is illustrated in FIGS. 6 and 7.

The fluid conduit 277 may be susceptible to refrigerant leaks at or near the brazed joint 281. Accordingly, the first refrigerant leak detector 204*a* and the second refrigerant leak detector 204*b* are disposed adjacent to the brazed joint, such as within six inches, one foot, two feet, or three feet of the brazed joint 281, such that any refrigerant leaked from the fluid conduit 277 at or adjacent to the brazed joint 281 is quickly identified. In some embodiments, the refrigerant leak detectors 204*a,* 204*b* are positioned underneath the fluid conduit 277 as the leaked refrigerant may tend to fall downardly toward the refrigerant leak detectors 204*a,* 204*b*. In some embodiments, as shown in FIG. 8, the first refrigerant leak detector 204*a* is positioned beneath a drain pan 280 of the RTU 200, while the second refrigerant leak detector 204*b* is positioned substantially level with the drain pan 280. Further, the first and second refrigerant leak detectors 204*a,* 204*b* are positioned in FIG. 8 between the evaporator 252 and an opposing panel 282 (e.g., partition, wall, etc.) separating the evaporator 252 from other componentry of the RTU 200, such as a gas heat exchanger.

In some embodiments, the second refrigerant leak detector 204*b* may be disposed on a ledge 284 (e.g., bracket, mounting bracket, etc.) coupled to the panel 282. Additionally or alternatively, in some embodiments, the first refrigerant leak detector 204*a,* the second refrigerant leak detector 204*b,* or a third refrigerant leak detector may be disposed in and/or otherwise coupled to the drain pan 280, adjacent to (e.g., within six inches, one foot, two feet, or three feet of) any other brazed joint(s) associated with the fluid conduit 277 or an additional fluid conduit, etc.

Figure 9:
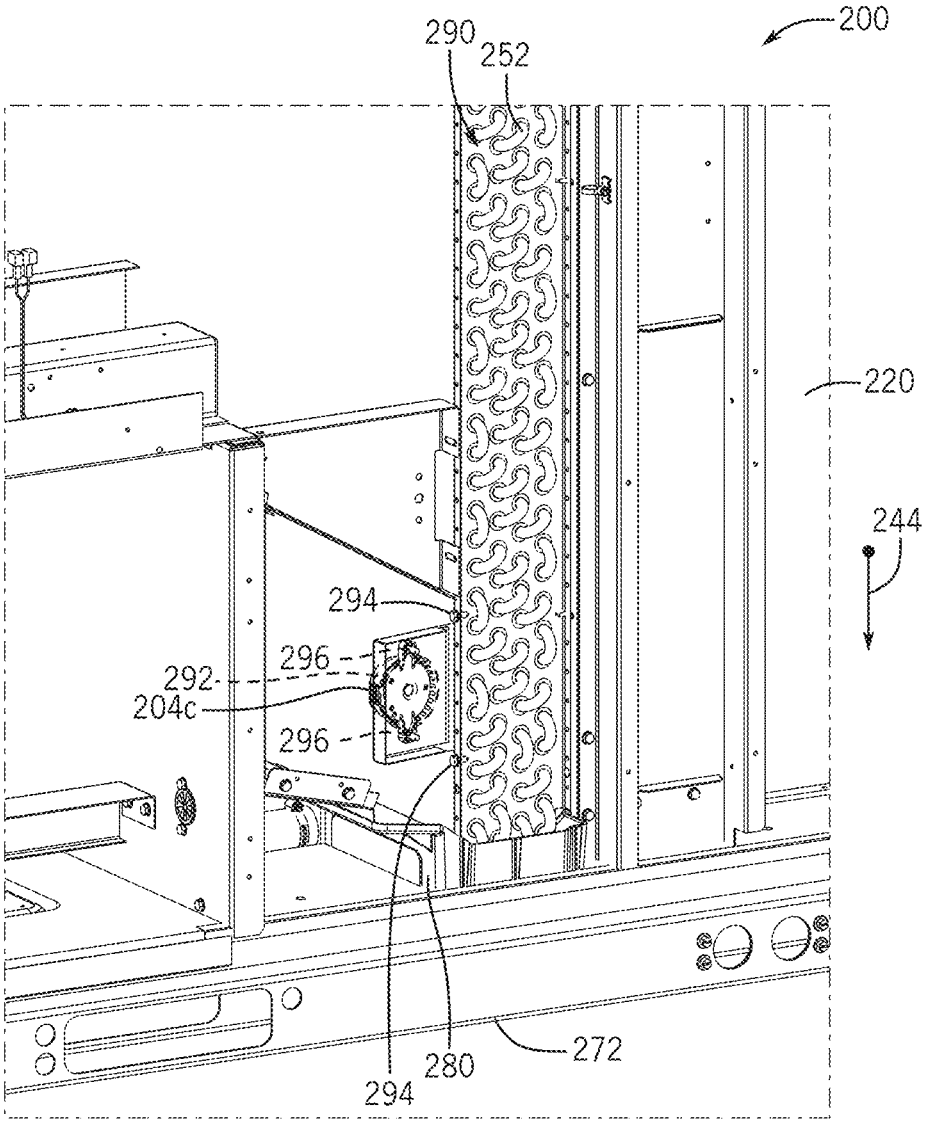
FIG. 9 is an isometric view of a portion of the RTU of FIG. 6, including a third refrigerant leak detector (e.g., used in addition to or in lieu of one or more other refrigerant leak detector[s] in FIG. 8) of the refrigerant leak detection assembly, in accordance with an aspect of the present disclosure.

FIG. 9 is an isometric view of a portion of the RTU 200 of FIG. 6, including a third refrigerant leak detector 204*c* (e.g., used in addition to or in lieu of one or more other refrigerant leak detector[s] in FIG. 8) of the refrigerant leak detection assembly 202. Certain of the componentry labeled and described with respect to FIGS. 6 and 7 may be labeled in FIG. 9, but some of said componentry may not be described in detail below. In the illustrated embodiment, the third refrigerant leak detector 204*c* is positioned adjacent to (e.g., within six inches, one foot, two feet, or three feet of) a hairpin side 290 of the evaporator 252, and above the drain pan 280. For example, as shown, the third refrigerant leak detector 204*c* may be coupled to the evaporator 252 (or a panel adjacent to the evaporator 252) via a mounting bracket 292 and fasteners 294 extending through the mounting bracket 292. Additional fasteners 296 may be employed to couple the third refrigerant leak detector 204*c* to the mounting bracket 292, as shown. In some embodiments, the hairpin side 290 of the evaporator 252 may be susceptible to refrigerant leaks and, thus, disposing the third refrigerant leak detector 204*c* adjacent to the hairpin side 290 of the evaporator 252 may enable the third refrigerant leak detector 204*c* to quickly detect any such refrigerant leak.

While the first and second refrigerant leak detectors 204*a,* 204*b* are robustly illustrated in FIG. 8 and the refrigerant leak detector 204*c* is robustly illustrated in FIG. 9, other refrigerant leak detectors 204 described below with respect to FIGS. 10-17 (and in at least one other embodiment illustrated in FIGS. 18-27) are illustrated schematically. It should be understood that the same or similar features of the refrigerant leak detectors 204*a,* 204*b,* and/or 204*c* illustrated in FIGS. 8 and 9, including any associated ledges and/or mounting brackets illustrated therein and described above, may be included in FIGS. 10-17 (and in at least one other embodiment illustrated in FIGS. 18-27).

FIG. 10 is an isometric view of a portion of the RTU 200 of FIG. 6, including a fourth refrigerant leak detector 204*d* (e.g., used in addition to or in lieu of one or more other refrigerant leak detector[s] in FIGS. 8 and 9) of the refrigerant leak detection assembly 202. Certain of the componentry labeled and described with respect to FIGS. 6 and 7 may be labeled in FIG. 10, but some of said componentry may not be described in detail below. In the illustrated embodiment, the fourth refrigerant leak detector 204*d* is disposed within the drain pan 280 or an elevated extension 300 (e.g., top level) from the drain pan 280. In other embodiments, the fourth refrigerant leak detector 204*d* may be positioned in an intermediate level or a lower level of the drain pan 280. In general, disposing the fourth refrigerant leak detector 204*d* at or adjacent to the base of the RTU 200 (e.g., in line with the rails 272) may improve quick detection of refrigerant leaks therein, as previously described, because the leaked refrigerant may tend to accumulate at or adjacent to the base of the RTU 200.

FIG. 11 is an isometric view of a portion of the RTU 200 of FIG. 6, including a fifth refrigerant leak detector 204*e* and a sixth refrigerant leak detector 204*f* (e.g., used in addition to or in lieu of one or more other refrigerant leak detector[s] in FIGS. 8-10) of the refrigerant leak detection assembly 202. Certain of the componentry labeled and described with respect to FIGS. 6 and 7 may be labeled in FIG. 11, but some of said componentry may not be described in detail below. In the illustrated embodiment, the fifth refrigerant leak detector 204*e* and the sixth refrigerant leak detector 204*f* are positioned within the control box 224, which may be defined within the RTU 200 at least in part by the housing 220 and at least in part by interior panels 228, 230 (and other possible panels/walls) of the RTU 200. That is, the control box 224 may be at least partially separated from other areas (e.g., sections, compartments, chambers, etc.) of the RTU 200.

In the illustrated embodiment, the control box 224 is separated into the low voltage compartment 232 receiving low voltage components and the high voltage compartment 234 receiving high voltage components, for example, by the bifurcating panel 236 (e.g., wall). The control board 222 may be distributed between the high voltage compartment 234 and the low voltage compartment 232 in certain embodiments, or the control board 222 may be disposed in one or the other. However, openings 310 through the panel 228 may enable leaked refrigerant from, for example, a chamber 312 corresponding to the evaporator 252 to migrate through the openings 310 and into the control box 224. The fifth refrigerant leak detector 204*e* may be disposed in the low voltage compartment 232 and the sixth refrigerant leak detector 204*f* may be disposed in the high voltage compartment 234, such that the fifth refrigerant leak detector 204*e* and/or the sixth refrigerant leak detector 204*f* can detect any such migratory refrigerant leaks.

FIG. 12 is an isometric view of a portion of the RTU 200 of FIG. 6, including a seventh refrigerant leak detector 204*g,* an eighth refrigerant leak detector 204*h,* and ninth refrigerant leak detector 204*i* (e.g., used in addition to or in lieu of one or more other refrigerant leak detector[s] in FIGS. 8-11) of the refrigerant leak detection assembly 202. Certain of the componentry labeled and described with respect to FIGS. 6 and 7 may be labeled in FIG. 12, but some of said componentry may not be described in detail below. In the illustrated embodiment, the ninth refrigerant leak detector 204*i* is positioned adjacent to (e.g., within six inches, one foot, two feet, or three feet of) the VFD 256. In this way, the ninth refrigerant leak detector 204*i* may detect leaked refrigerant adjacent to the VFD 256, which may be negatively impacted by contact with the leaked refrigerant, so that appropriate actions may be taken (e.g., an alert transmitted, a shutdown of the VFD 256, and/or some other action). Additionally or alternatively, the eighth refrigerant leak detector 204*h* is positioned adjacent to a gas heat exchanger (shown and labeled as reference numeral 274 in FIG. 6), such as within a gas heat exchanger chamber 320 separated from the evaporator chamber 260 and corresponding evaporator 252 by the partition 228. In this way, the eighth refrigerant leak detector 204*h* may detect leaked refrigerant adjacent to the gas heat exchanger, which may be negatively impacted by contact with the leaked refrigerant, so that appropriate actions may be taken (e.g., an alert transmitted, operation of the gas heat exchanger or fluid flows thereto controlled or changed, or some other action). Additionally or alternatively, the seventh refrigerant leak detector 204*g* is positioned at or adjacent to a support 322 on which a motor (shown and labeled as reference numeral 258 in FIG. 6). In this way, the seventh refrigerant leak detector 204*g* may detect leaked refrigerant adjacent to the motor, which may be negatively impacted by contact with the leaked refrigerant, so that appropriate actions may be taken (e.g., an alert transmitted, a shutdown of the motor, and/or some other action).

FIG. 13 is an isometric view of a portion of the RTU 200 of FIG. 6, including a tenth refrigerant leak detector 204*j* (e.g., used in addition to or in lieu of one or more other refrigerant leak detector[s] in FIGS. 8-12) of the refrigerant leak detection assembly 202. Certain of the componentry labeled and described with respect to FIGS. 6 and 7 may be labeled in FIG. 13, but some of said componentry may not be described in detail below. In the illustrated embodiment, a partition 330 may separate an indoor section (e.g., the blower chamber 250 with the blowers 254 therein and/or the evaporator chamber 260 with the evaporator 252 therein) from an outdoor section (not shown, but corresponding to the condenser 264 in FIGS. 6 and 7) of the RTU 200. The tenth refrigerant leak detector 204*j* may be positioned at, on, or adjacent to the partition 330.

FIG. 14 is an isometric view of a portion of the RTU 200 of FIG. 6, including an eleventh refrigerant leak detector 204*k* and a twelfth refrigerant leak detector 2041 (e.g., used in addition to or in lieu of one or more other refrigerant leak detector[s] in FIGS. 8-13) of the refrigerant leak detection assembly 202. Certain of the componentry labeled and described with respect to FIGS. 6 and 7 may be labeled in FIG. 14, but some of said componentry may not be described in detail below. In the illustrated embodiment, the twelfth refrigerant leak detector 2041 is positioned on a first side 340*a* of an inlet 342*a* of a first blower 254*a* and the eleventh refrigerant leak detector 204*k* is positioned on a first side 340*b* of an inlet 342*b* of a second blower 254*b*. In this way, the eleventh refrigerant leak detector 204*k* and the twelfth refrigerant leak detector 2041 are configured to detect leaked refrigerant entrained or otherwise mixed with an air flow prior entering the blowers 254*a*, 254*b*, such that appropriate actions (e.g., transmitting an alert, blocking or changing operation of the blowers 254*a*, 254*b*, or some other action) may be taken.

FIG. 15 is an isometric view of a portion of the RTU 200 of FIG. 6, including a thirteenth refrigerant leak detector 204*m* and a fourteenth refrigerant leak detector 204*n* (e.g., used in addition to or in lieu of one or more other refrigerant leak detector[s] in FIGS. 8-14) of the refrigerant leak detection assembly 202. Certain of the componentry labeled and described with respect to FIGS. 6 and 7 may be labeled in FIG. 15, but some of said componentry may not be described in detail below. As shown in FIG. 15, the fourteenth refrigerant leak detector 204*n* may be disposed on an opposing side 346*a* of the inlet 342*a* to the first blower 252*a* and the thirteenth refrigerant leak detector 204*m* may be disposed on an opposing side 346*b* of the inlet 342*b* to the second blower 252*b*. In this way, the thirteenth refrigerant leak detector 204*m* and the fourteenth refrigerant leak detector 204*n* are configured to detect leaked refrigerant entrained or otherwise mixed with an air flow prior entering the blowers 254*a*, 254*b*, such that appropriate actions (e.g., transmitting an alert, blocking or changing operation of the blowers 254*a*, 254*b*, or some other action) may be taken. Although not shown in FIGS. 14 and 15, in some embodiments, one or more refrigerant leak detectors may be disposed on a support 360 extending between the first blower 254*a* and the second blower 254*b*.

FIG. 16 is an isometric view of a portion of the RTU 200 of FIG. 6, including a fifteenth refrigerant leak detector 2040 and a sixteenth refrigerant leak detector 204*p* (e.g., used in addition to or in lieu of one or more other refrigerant leak detector[s] in FIGS. 8-15) of the refrigerant leak detection assembly 202. Certain of the componentry labeled and described with respect to FIGS. 6 and 7 may be labeled in FIG. 16, but some of said componentry may not be described in detail below. In the illustrated embodiment, the fifteenth refrigerant leak detector 2040 is positioned at, in, or adjacent to an outlet 370*b* of the second blower 254*b*, and the sixteenth refrigerant leak detector 204*p* is positioned at, in, or adjacent to an outlet 370*a* of the first blower 254*a*. In this way, the fifteenth refrigerant leak detector 204*o* and the sixteenth refrigerant leak detector 204*lp* are configured to detect leaked refrigerant entrained or otherwise mixed with an air flow (e.g., a supply air flow) prior to the air flow reaching a conditioned space, such that appropriate actions (e.g., transmitting an alert, blocking or changing operation of the blowers 254*a*, 254*b*, or some other action) may be taken. In some operating scenarios, if the blowers 254*a*, 254*b* fail to operate, air may flow from the blowers 254*a*, 254*b* towards the return air section (labeled with reference numeral 238 in at least FIGS. 6 and 7). If refrigerant is leaked during blower failure, the leaked refrigerant may mix with air and flow along with the air towards the return air section. As such, air contaminated with the leaked refrigerant may flow through return air ducts into the conditioned space. Accordingly, the fifteenth refrigerant leak detector 204*o* and the sixteenth refrigerant leak detector 204*lp*, along with other possible refrigerant leak detectors 204, may be employed at the return air section to detect refrigerant leakage.

FIG. 17 is an isometric view of a portion of the RTU of FIG. 6, including a seventeenth refrigerant leak detector 204*q*, an eighteenth refrigerant leak detector 204*r*, a nineteenth refrigerant leak detector 204*s*, a twentieth refrigerant leak detector 204*t*, a twenty first refrigerant leak detector 204*u*, a twenty second refrigerant leak detector 204*v*, and a twenty third refrigerant leak detector 204*w* (e.g., used in addition to or in lieu of one or more other refrigerant leak detector[s] in FIGS. 8-16) of the refrigerant leak detection assembly 202. Certain of the componentry labeled and described with respect to FIGS. 6 and 7 may be labeled in FIG. 17, but some of said componentry may not be described in detail below. In the illustrated embodiment, the nineteenth refrigerant leak detector 204*s* and the twentieth refrigerant leak detector 204*t* are positioned at the return air inlet 239. Further, the seventeenth refrigerant leak detector 204*q*, the eighteenth refrigerant leak detector 204*r*, the twenty first refrigerant leak detector 204*u*, the twenty second refrigerant leak detector 204*v*, and the twenty third refrigerant leak detector 204*w* are positioned on or adjacent to the filter assembly 248 (e.g., adjacent to corners of the filter assembly 248 and/or in a middle of the filter assembly 248). The filter assembly 248 may include a single filtering member or multiple filtering members arranged in a specific orientation (e.g., laterally across the RTU 200). In some embodiments, one or more additional refrigerant leak detectors 204 may be disposed along an operative rear surface 390 of the control box 224.

As previously noted, embodiments of the present disclosure may include some but not all of the refrigerant leak detectors 204 described above. For example, described above with respect to various ones of FIGS. 8-17 are the first refrigerant leak detector 204*a*, the second refrigerant leak detector 204*b*, the third refrigerant leak detector 204*c*, the fourth refrigerant leak detector 204*d*, the fifth refrigerant leak detector 204*e*, the sixth refrigerant leak detector 204*f*, the seventh refrigerant leak detector 204*g*, the eighth refrigerant leak detector 204*h*, the ninth refrigerant leak detector 204*i*, the tenth refrigerant leak detector 204*j*, the eleventh refrigerant leak detector 204*k*, the twelfth refrigerant leak detector 204*l*, the thirteenth refrigerant leak detector 204*m*, the fourteenth refrigerant leak detector 204*n*, the fifteenth refrigerant leak detector 204*o*, the sixteenth refrigerant leak detector 204*p*, the seventeenth refrigerant leak detector 204*q*, the eighteenth refrigerant leak detector 204*r*, the nineteenth refrigerant leak detector 204*s*, the twentieth refrigerant leak detector 204*t*, the twenty first refrigerant leak detector 204*u*, the twenty second refrigerant leak detector 204*v*, and the twenty third refrigerant leak detector 204*w*. However, it should be understood that embodiments of the RTU 200 need not necessarily include all twenty-three refrigerant leak detectors 204. For example, certain embodiments of the RTU 200 in accordance with the present disclosure may include any combination of two or more of such refrigerant leak detectors 204.

As previously described, FIGS. 6-17 are directed to a first embodiment of the RTU 100 of FIG. 5 (e.g., the RTU 200), whereas FIGS. 18 and 19 are directed to a second embodiment of the RTU 100 of FIG. 5 (e.g., the RTU 400), FIGS. 20-22 are directed to a third embodiment of the RTU 100 of FIG. 5 (e.g., the RTU 500), FIGS. 23-25 are directed to a fourth embodiment of the RTU 100 of FIG. 5 (e.g., the RTU 600), and FIGS. 26 and 27 are directed to a fifth embodiment of the RTU 100 of FIG. 5 (e.g., RTU 700). The second, third, fourth, and fifth embodiments are described in detail below.

FIG. 18 is an isometric view of an embodiment of a portion of the RTU 400, including a first refrigerant leak detector 404*a*, a second refrigerant leak detector 404*b*, a third refrigerant leak detector 404*c*, a fourth refrigerant leak detector 404*d*, a fifth refrigerant leak detector 404*e*, a sixth refrigerant leak detector 404*f*, and a seventh refrigerant leak detector 404*g* of the refrigerant leak detection assembly 402. As shown, the RTU 400 includes an evaporator 406, a drain pan 408, and blowers 410*a*, 410*b* provided in a housing 412 (nothing that only a frame of the housing 412 is shown in FIG. 18). The RTU 400 may include other suitable components required for functioning of the RTU 400, such as similar componentry described with respect to the RTU(s) 200 in FIGS. 6-17. The RTU 400 in FIG. 18 also includes a header side 414 of the evaporator 406. At least the first refrigerant leak detector 404*a*, the second refrigerant leak detector 404*b*, and the third refrigerant leak detector 404*c* may be positioned adjacent to (e.g., within six inches, one foot, two feet, or three feet of) the header side 414 of the evaporator 406 of the RTU 400. In some embodiments, the header side 414 is susceptible to refrigerant leaks.

Further, the third refrigerant leak detector 404*c* may be positioned adjacent to (e.g., within six inches, one foot, two feet, or three feet of) a hairpin side 416 of the evaporator 406, and the first refrigerant leak detector 404*a* may be positioned adjacent to (e.g., within six inches, one foot, two feet, or three feet of) an expansion valve 418 of the RTU 400. In some embodiments, the hairpin side 416 of the evaporator 406 and/or the expansion valve 418 are susceptible to refrigerant leaks. The fourth refrigerant leak detector 404*d* may be positioned adjacent to a brazed joint 420 coupling two portions of a fluid conduit. In this way, refrigerant leaks from the hairpin side 416 of the evaporator 418, the expansion valve 418, and/or the brazed joint 420 may be quickly detected. Although not marked in the illustrated embodiment, as previously described, one or more refrigerant leak detectors may be disposed in, on, or adjacent to a drain pan underneath the evaporator 406. The fifth refrigerant leak detector 404*e* and the sixth refrigerant leak detector 404*f* may be positioned at, on, or adjacent to (e.g., within six inches, one foot, two feet, or three feet of) a bottom discharge 422 of the RTU 400, noting that in some embodiments, the RTU 400 may additionally or alternatively include a side and/or top discharge.

For example, FIG. 19 is an isometric view of a portion of the RTU 400 of FIG. 18, including an eighth refrigerant leak detector 404*h* disposed adjacent to a side discharge 430 of the RTU 400, a ninth refrigerant leak detector 404*i*, and a tenth refrigerant leak detector 404*j* (e.g., used in addition to or in lieu of one or more other refrigerant leak detector[s] in FIG. 18) of the refrigerant leak detection assembly 402. The ninth refrigerant leak detector 404*i* may be positioned adjacent to an opposing side discharge of the RTU 400 and/or the bottom discharge 422, and the tenth refrigerant leak detector 404*j* may be positioned adjacent to an additional brazed joint and/or the bottom discharge 422. Certain of the componentry labeled and described with respect to FIG. 18 may be labeled in FIG. 19, but some of said componentry may not be described above.

FIG. 20 is an isometric view of an embodiment of a portion of the RTU 500, including a first refrigerant leak detector 504*a*, a second refrigerant leak detector 504*b*, and a third refrigerant leak detector 504*c* of the refrigerant leak detection assembly 502. In the illustrated embodiment, the RTU 500 includes a first evaporator 506 (e.g., first evaporator coil) having a first hairpin side 507 and a second evaporator 508 (e.g., second evaporator coil) having a second hairpin side 509 along with other suitable components placed within the housing 412. The first refrigerant leak detector 504*a* is positioned adjacent to a bottom end of the hairpin side 509 of the second evaporator 508 (which may be susceptible to refrigerant leaks), and the second refrigerant leak detector 506*b* is positioned adjacent to a bottom end of the hairpin side 507 of the first evaporator 506 (which may be susceptible to refrigerant leaks). The third detector 504*c* is positioned adjacent to, for example, an assembly 510 including an expansion valve, a brazed joint coupling two portions of a fluid conduit, and/or some other refrigerant leak source (e.g., proximate a header side 511 of the first evaporator 506). The above-described components may be disposed, for example, in a housing 512 of the RTU 500.

FIG. 21 is an isometric view of a portion of the RTU 500 of FIG. 20 (e.g., illustrating an opposing side of the RTU 500 relative to FIG. 20), including a fourth refrigerant leak detector 504*d* and a fifth refrigerant leak detector 504*e* (e.g., used in addition to or in lieu of one or more other refrigerant leak detector[s] in FIG. 20) of the refrigerant leak detection assembly 502. The fourth refrigerant leak detector 504*d* and the fifth refrigerant leak detector 504*e* may be positioned adjacent to (e.g., within six inches, one foot, two feet, or three feet of) and/or below corresponding assemblies 510 including an expansion valve, a brazed joint coupling two portions of a fluid conduit, and/or some other refrigerant leak source (e.g., proximate to header sides 511, 513 of the first and second evaporator 506, 508, respectively).

FIG. 22 is an isometric view of a portion of the RTU 400 of FIG. 20, including a sixth refrigerant leak detector 504*f*, a seventh refrigerant leak detector 504*g*, an eighth refrigerant leak detector 504*h*, a ninth refrigerant leak detector 504*i*, and a tenth refrigerant leak detector 504*j* (e.g., used in addition to or in lieu of one or more other refrigerant leak detector[s] in FIGS. 20 and 21) of the refrigerant leak detection assembly 504. The various refrigerant leak detectors 504*f*, 504*g*, 504*h*, 504*i*, 504*j* may be positioned at, on, or adjacent to the side discharges 530 and/or the bottom discharge 532 of the RTU 500. In other embodiments, one or more detectors may be positioned at, on, or adjacent to a top discharge of the RTU 500. Additionally or alternatively, at least the ninth refrigerant leak detector 504*i* and the tenth refrigerant leak detector 504*j* may be positioned adjacent to (e.g., within six inches, one foot, two feet, or three feet) a fluid conduit configured to convey a refrigerant and including a brazed joint between first and second portions of the fluid conduit.

FIG. 23 is an isometric view of an embodiment of a portion of the RTU 600, including a first refrigerant leak detector 604*a*, a second refrigerant leak detector 604*b*, and a third refrigerant leak detector 604*c* of the refrigerant leak detection assembly 602. In the illustrated embodiment, the RTU 600 includes a first evaporator coil 606 (e.g., V-shaped and/or sloped evaporator coil) and a second evaporator coil 608 (e.g., V-shaped and/or sloped evaporator coil). A first hairpin side 607 of the first evaporator coil 606 and a second hairpin side 609 of the second evaporator coil 608 are illustrated in FIG. 23. The first refrigerant leak detector 604*a* is positioned adjacent to a base of the first hairpin side 607 of the first evaporator coil 606, and the second refrigerant leak detector 604*b* is positioned adjacent to a base of the second hairpin side 609 of the second evaporator coil 608. In some embodiments, the first refrigerant leak detector 604*a* is coupled to the first evaporator coil 606 and/or the second refrigerant leak detector 604*b* is coupled to the second evaporator coil 608.

FIG. 24 is an isometric view of a portion of the RTU 600 of FIG. 23, including a fourth refrigerant leak detector 604*d* and a fifth refrigerant leak detector 604*e* (e.g., used in addition to or in lieu of one or more other refrigerant leak detector[s] in FIG. 23) of the refrigerant leak detection assembly 602. A first header side 610 of the first evaporator coil 606 and a second header side 612 of the second evaporator coil 608 are shown in the illustrated embodiment. The fourth refrigerant leak detector 604*d* is positioned adjacent to a base of the first header side 610 of the first evaporator coil 606, and the fifth refrigerant leak detector 604*e* is positioned adjacent to a base of the second header side 612 of the second evaporator coil 608. Additionally or alternatively, in some embodiments, the fourth refrigerant leak detector 604*d* and/or the fifth refrigerant leak detector 604*e* may be positioned adjacent to other refrigerant leak sources, such as an expansion valve, a brazed joint between first and second portions of a refrigerant conduit, etc.

FIG. 25 is an isometric view of a portion of the RTU 600 of FIG. 23, including a sixth refrigerant leak detector 604*f*, a seventh refrigerant leak detector 604*g*, an eighth refrigerant leak detector 604*h*, and a ninth refrigerant leak detector 604*i* (e.g., used in addition to or in lieu of one or more other refrigerant leak detector[s] in FIGS. 23 and 24) of the refrigerant leak detection assembly 602. The RTU 600 includes at least one side discharge 614 (e.g., first and second side discharges 614), a bottom discharge 616, or a combination thereof. The sixth refrigerant leak detector 604*f* is positioned adjacent to one of the side discharges 614 and/or the bottom discharge 616, the seventh refrigerant leak detector 604*g* is positioned adjacent to the bottom discharge 616, the eighth refrigerant leak detector 604*h* is positioned adjacent to one of the side discharges 614 and/or the bottom discharge 616, and the ninth refrigerant leak detector 604*i* is positioned adjacent to one of the side discharges 614. In some embodiments, the eighth refrigerant leak detector 604*h* and/or the ninth refrigerant leak detector 604*i* may additionally or alternatively be positioned adjacent to a refrigerant leak source, such as a brazed joint of a refrigerant conduit and/or an expansion valve.

FIG. 26 is an isometric view of an embodiment of a portion of the RTU 700, including a first refrigerant leak detector 704*a*, a second first refrigerant leak detector 704*b*, and a third second refrigerant leak detector 704*c* of the refrigerant leak detection assembly 702. In the illustrated embodiment, the RTU 700 includes an evaporator 706 having a header side 708 and a hairpin side 710. The second refrigerant leak detector 704*b* and the third refrigerant leak detector 704*b* are positioned adjacent to (e.g., within 6 inches, one foot, two feet, or three feet) the header side 708 of the evaporator 706 (and, in some embodiments, coupled to the evaporator 706). The first refrigerant leak detector 704*a* is positioned adjacent to and/or in a drain pan 712 of the RTU 700. FIG. 27 is an isometric view of a portion of the RTU 700 of FIG. 26, including a fourth refrigerant leak detector 704*d* (e.g., used in addition to or in lieu of one or more other refrigerant leak detector[s] in FIG. 26) of the refrigerant leak detection assembly 702. The fourth refrigerant leak detector 704*d* is positioned adjacent to the hairpin side 710 of the evaporator 706.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform] ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A rooftop unit (RTU), comprising:

a fluid conduit configured to convey a refrigerant, wherein the fluid conduit comprises a first portion, a second portion, and a brazed joint coupling the first portion and the second portion;

a plurality of refrigerant leak detectors, wherein a refrigerant leak detector of the plurality of refrigerant leak detectors is positioned adjacent to the brazed joint; and a control box chamber having controls circuitry disposed therein, wherein an additional refrigerant leak detector of the plurality of refrigerant leak detectors is positioned within the control box chamber, and wherein the controls circuitry is configured to:

receive sensor feedback indicative of a refrigerant leak from the refrigerant leak detector, the additional refrigerant leak detector, or both; and perform an action based on the sensor feedback.

2. The RTU of claim 1, comprising:

a drain pan; and a third refrigerant leak detector of the plurality of refrigerant leak detectors, wherein the third refrigerant leak detector is coupled to the drain pan.

3. The RTU of claim 1, comprising:

an evaporator; and a third refrigerant leak detector of the plurality of refrigerant leak detectors, wherein the third refrigerant leak detector is coupled to the evaporator, disposed in an evaporator chamber having the evaporator therein, or both.

4. The RTU of claim 1, comprising at least one panel separating the control box chamber from an additional chamber in which the brazed joint is disposed, wherein the at least one panel comprises an opening, and the additional refrigerant leak detector is configured to detect leaked refrigerant migrating from the additional chamber, through the opening in the at least one panel, and into the control box chamber.

5. The RTU of claim 1, comprising:

a chamber;

a blower disposed in the chamber; and a third refrigerant leak detector of the plurality of refrigerant leak detectors, wherein the third refrigerant leak detector is positioned in the chamber and coupled to the blower.

6. The RTU of claim 1, comprising:

a return air chamber fluidly coupled with a return air inlet of the RTU; and a third refrigerant leak detector of the plurality of refrigerant leak detectors, wherein the third refrigerant leak detector is positioned in the return air chamber.

7. The RTU of claim 1, wherein the controls circuitry is configured to perform the action based on the sensor feedback by transmitting an alert indicative of the refrigerant leak, control a blower of the RTU, control a compressor of the RTU, or any combination thereof.

8. A rooftop unit (RTU), comprising:

a chamber;

an additional chamber forming a control box in which controls circuitry of the RTU is disposed, wherein the control box comprises a high voltage cavity having a high voltage portion of the controls circuitry disposed therein, a low voltage cavity having a low voltage portion of the controls circuitry disposed therein, and at least one panel separating the high voltage cavity from the low voltage cavity;

at least one additional panel positioned between the chamber and the additional chamber and comprising an opening establishing a fluid coupling between the chamber and the additional chamber; and a plurality of refrigerant leak detectors, wherein a refrigerant leak detector of the plurality of refrigerant leak detectors is positioned in the additional chamber and configured to detect a migration of leaked refrigerant from the chamber, through the opening, and into the additional chamber, and wherein the controls circuitry is configured to:

receive sensor feedback indicative of the leaked refrigerant from the refrigerant leak detector; and perform an action based on the sensor feedback.

9. The RTU of claim 8, wherein:

the refrigerant leak detector is positioned in the high voltage cavity; and an additional refrigerant leak detector of the plurality of refrigerant leak detectors is positioned in the low voltage cavity.

10. The RTU of claim 8, comprising:

a fluid conduit configured to convey a refrigerant, wherein the fluid conduit comprises a first portion, a second portion, and a brazed joint coupling the first portion and the second portion;

a blower configured to generate an air flow; and an additional refrigerant leak detector of the plurality of refrigerant leak detectors, wherein the additional refrigerant leak detector is coupled to the blower or positioned adjacent to the brazed joint.

11. A rooftop unit (RTU), comprising:

a fluid conduit configured to convey a refrigerant, wherein the fluid conduit comprises a first portion, a second portion, and a brazed joint coupling the first portion and the second portion;

a plurality of refrigerant leak detectors, wherein a refrigerant leak detector of the plurality of refrigerant leak detectors is positioned adjacent to the brazed joint;

a chamber;

a blower disposed in the chamber;

an additional refrigerant leak detector of the plurality of refrigerant leak detectors, wherein the additional refrigerant leak detector is positioned in the chamber and coupled to the blower; and controls circuitry configured to:

receive sensor feedback indicative of a refrigerant leak from the refrigerant leak detector, the additional refrigerant leak detector, or both; and perform an action based on the sensor feedback.

12. A rooftop unit (RTU), comprising:

a fluid conduit configured to convey a refrigerant, wherein the fluid conduit comprises a first portion, a second portion, and a brazed joint coupling the first portion and the second portion;

a plurality of refrigerant leak detectors, wherein a refrigerant leak detector of the plurality of refrigerant leak detectors is positioned adjacent to the brazed joint;

a return air chamber fluidly coupled with a return air inlet of the RTU, wherein the plurality of refrigerant leak detectors comprises an additional refrigerant leak detector positioned in the return air chamber; and controls circuitry configured to:

receive sensor feedback indicative of a refrigerant leak from the refrigerant leak detector, the additional refrigerant leak detector, or both; and perform an action based on the sensor feedback.

13. A rooftop unit (RTU), comprising:

a chamber;

an additional chamber forming a control box in which controls circuitry of the RTU is disposed;

at least one panel positioned between the chamber and the additional chamber and comprising an opening establishing a fluid coupling between the chamber and the additional chamber;

a plurality of refrigerant leak detectors, wherein a refrigerant leak detector of the plurality of refrigerant leak detectors is positioned in the additional chamber and configured to detect a migration of leaked refrigerant from the chamber, through the opening, and into the additional chamber;

a fluid conduit configured to convey a refrigerant, wherein the fluid conduit comprises a first portion, a second portion, and a brazed joint coupling the first portion and the second portion;

a blower configured to generate an air flow;

an additional refrigerant leak detector of the plurality of refrigerant leak detectors, wherein the additional refrigerant leak detector is coupled to the blower or positioned adjacent to the brazed joint, and wherein the controls circuitry is configured to:

receive sensor feedback indicative of the leaked refrigerant from the refrigerant leak detector, indicative of additional leaked refrigerant from the additional refrigerant leak detector, or indicative of the leaked refrigerant from the refrigerant leak detector and the additional leaked refrigerant from the additional refrigerant leak detector; and perform an action based on the sensor feedback.

* * * * *